US005890446A

United States Patent [19]

Koshinaka

[11] Patent Number: 5,890,446

[45] Date of Patent: Apr. 6, 1999

[54] CONVERTIBLE LOCK AND OVER-LOCK SEWING MACHINE

[75] Inventor: Osamu Koshinaka, Higashi-Osaka, Japan

[73] Assignee: Hosei Mishin Seizo Kabushiki Kaisha, Osaka, Japan

[21] Appl. No.: 697,165

[22] Filed: Aug. 20, 1996

[30] Foreign Application Priority Data

Sep. 20, 1995 [JP] Japan ..... 7-267845
Feb. 19, 1996 [JP] Japan ..... 8-056846

[51] Int. Cl.[6] ..... D05B 3/24; D05B 1/14

[52] U.S. Cl. ..... 112/168; 112/260

[58] Field of Search ..... 112/168, 162, 112/166, 260, 189, 192, 258

[56] References Cited

U.S. PATENT DOCUMENTS 2,609,770 9/1952 Christensen ..... 112/168
4,343,250 8/1982 Hanyu et al. ..... 112/168
4,590,875 5/1986 Sanvito et al. ..... 112/168
4,624,201 11/1986 Maggi ..... 112/168
4,967,677 11/1990 Seiriki et al. .

*Primary Examiner*—Ismael Izaguirre
*Attorney, Agent, or Firm*—Wenderoth, Lind & Ponack, L.L.P.

[57] ABSTRACT

A bed portion, minutely speaking, a portion corresponding to a rise-and-fall position of a needle, of a lock stitching machine or an over-lock stitching machine is formed into a unit and combined with a machine proper in a mounting/detaching free state, and uses plural sewing units that are selectively exchanged for each other. The machine proper 1 is formed by cutting of a top portion of a bed 1" on the right of a needle plate portion, leaving the cut-off portion as a connecting surface 5. A sewing unit 2 or 3 is formed by providing a needle plate 12, feeding teeth 13, a shuttle drive mechanism 15, a cloth feed mechanism 19 or loopers 47 and 49 and their drive mechanism 48 and 58 in one unit body. Its right side is left as a connecting surface 20, and the two elements are combined as one body in a mounting/detaching free state through a shaft coupling 7, a fitting portion 10 and a combining means 11, respectively protruding on the abovementioned two connecting surface.

17 Claims, 30 Drawing Sheets

CONVERTIBLE LOCK AND OVER-LOCK SEWING MACHINE

BACKGROUND OF THE INVENTION (1) Field of the Invention

The present invention is related to a sewing machine and characterized by forming a machine with a vertical cut-off part of the bed of a sewing machine at an appropriate point on the right-hand side of a rise-and-fall position of a needle, and also forming a sewing unit provided with a needle plate, a feeding teeth, a shuttle or a looper, etc., and connecting the sewing unit to the cut-off part of the bed of the sewing machine so as to perform a desired stitching.

(2) State of the Prior Art

Conventional sewing machines may be divided into two types, for example, a locking stitching machine which can perform lock stitching or zigzag stitching optionally, and a lock stitching machine which can perform over-lock stitching or cover hemming.

Further, there is a sewing machine as disclosed in U.S. Pat. No. 4,967,677, owned by the applicant of the present application, and applicable to a combined use for lock stitching and over-lock stitching.

The above-mentioned conventional sewing machine having a combined use for lock stitching and over-lock stitching is provided on a portion of a bed with a shuttle and a driving means for lock stitching, and at the same time is provided with upper and lower loopers and driving means for over-lock stitching. It is able to select either lock stitching or over-lock stitching by operating an actuation switch-over means provided on the bed portion.

Among the above-mentioned conventional sewing machines, the first cited machines are respectively of almost single capacity. Therefore, in the case of users desiring various kinds of stitchings, it is required to have a plural number of sewing machines of different stitching functions. Thus, users need to buy many sewing machines.

While in the case of the example cited last, over-lock stitching as well as lock stitching including zigzag stitching and pattern stitching can be performed by a single sewing machine. Therefore, the latter has an advantage in that it is less expensive than the former, but, at the same time it has a disadvantage in that it has to set various elements in its narrow bed, and thereby becomes complicated in structure, difficult to assemble and high in manufacturing cost, Moreover, the functions given to the machine may interfere with each other and thereby cannot be fully used.

Thus, it has been a problem to develop a sewing machine which is easy for users to operate and easy to manufacture while being hard to break down, and which enables users to perform their desired mode of stitching selectively.

SUMMARY OF THE INVENTION

The present invention provides a sewing machine constituted by forming a machine by cutting off the left end portion of a bed of the machine on the right of a rise-and-fall position of a needle while leaving the cut-off side as a connecting surface, and by exposing on the connecting surface a shaft coupling of a lower shaft, a fitting portion to a sewing unit and a combining portion of a combining means to a sewing unit. A sewing unit is formed by setting, in one unit body, at least a needle plate, feeding teeth, and a rotary shaft linked with a cloth feeding mechanism and with a shaft coupling of a lower shaft, while leaving its right side as a connecting surface to contact the connecting surface of the machine proper. The machine proper is combined with the sewing unit as one body by linking the above-mentioned shaft couplings, fitting portions and combining portions of the combining means exposed on the two surfaces of the machine proper and the sewing unit with each other in a detachable state, and joining the two surfaces.

The sewing machine of the present invention, in which the machine proper and the sewing unit are produced separately and then are put together, makes manufacture and assembly easy as compared with conventional sewing machines, which have to set a large number of necessary elements into one body.

The sewing machine of the present invention, in which a plural number of sewing units having respectively different functions, can use the units in exchange for each other with one machine proper. It has such advantages in that the cost of manufacture comes down as compared with the case of manufacturing sewing machines separately by single function. Users can perform various modes of stitching selectively by using one sewing machine. Further, the exchange of the sewing units can be done easily and there is no need to install many sewing machines.

When comparing the sewing machine of the present invention, designed to have separate sewing units by stitching function with conventional sewing machines provided with elements of various stitching modes in one body, each unit becomes simpler in structure, easier to manufacture, higher in accuracy of product, and fewer in the number of break-downs or mis-actuations.

The sewing machine of the present invention can be used as an ordinary lock stitching machine by using a lock stitch unit, in which are fitted a needle plate, feeding teeth, a shuttle, a cloth feeding means and a shuttle driving means. Provided on the connecting surface of the sewing unit are a shaft to be linked with a shaft coupling of a lower shaft and with a shaft coupling of a cloth feed control shaft in a detachable state, a fitting portion to be fitted into a fitting portion of the machine proper in a detachable state and a combining portion to be combined with a combining portion of a combining means. By connecting such a sewing unit to the machine proper, a lock stitching function is provided.

The sewing machine of the present invention can be used as an ordinary over-lock stitching machine by using an over-lock stitch unit, in which are fitted a needle plate, feeding teeth, a looper mechanism and a knife mechanism, a cloth feeding mechanism, a looper driving mechanism and a knife driving mechanism, and in which are provided on the connecting surface of the unit a shaft coupling to be linked with a shaft coupling of a lower shaft in a detachable state, a fitting portion to be fitted into a fitting portion of the machine proper in a detachable state, and a combining portion to be combined with a combining portion of a combining means. By connecting such a sewing unit to the machine proper an over-lock stitching function is provided.

The sewing machine of the present invention can be used as an ordinary cover hemming machine by using a covering hem unit, in which are fitted a needle plate, feeding teeth, a cover hemming looper, a cloth feeding mechanism and a covering hem looper driving mechanism. In the right side of unit body is formed a connecting surface to be joined with a connecting surface of the machine proper. Provided on the connecting surface are a shaft coupling to be linked with a shaft coupling of a lower shaft in a detachable state, a fitting portion to be fitted into a fitting portion of the machine proper in a detachable state, and a combining portion to be combined with a combining portion of a combining means.

By connecting such sewing unit to the machine proper having a flat stitching function is provided.

The sewing unit is provided on its connecting surface with a combining portion formed into a backward motion stopping tooth shape. The combining means of the machine proper, to be combined with the combining portion of the sewing unit, is provided at its top end with a hook-shaped combining portion for hooking the combining portion of a backward motion stopping tooth shape such that it can swing freely in a horizontal direction. An operation lever is exposed at its bottom end on the outer side of a traction spring which pulls the operation lever with force normally in a direction of combination, and permits the operation lever to pass elastically in a direction of inserting the combining portion of a backward motion stopping tooth shape into the hook-shaped combining portion. Such action of the traction spring enables the pulling of the connecting surface of the machine proper and the sewing unit to each other, maintains the connected state firmly and releases such state easily.

In the present invention, a rotation stopping position of the lower shaft comes automatically into accord with the risen position of a needle by providing a slit to set the rotation stopping position of the lower shaft to the risen position of a needle on the circumference of the shaft coupling of the machine proper in parallel with the shaft line of the lower shaft. Along an operation lever is a position setting lever with its top end fitted into the slit and with the other end in touch with the operation lever. A spring connects the two levers, with a swing of the position setting lever following a swing in a direction of releasing the combination of the operation lever.

Therefore, it is possible to avoid the mounting and detaching of the sewing unit with the lowered condition of the needle. Thus, the exchange of one sewing unit for another can be done safely, without breaking the needle.

In the present invention, it becomes possible to mount and detach a shaft coupling together with the mounting and detaching of the sewing unit to the machine proper by forming the shaft coupling of the machine proper and that of the sewing unit into a disk shape falling respectively at right angles with their shaft line, The rotation of the lever shaft is transmitted to the sewing unit by an engagement between a groove and a protruded stripe formed along a diameter direction of their connecting surfaces. Thus, the present invention is excellent in operational efficiency and can carry out smooth transmission of rotation to the driving elements.

In the present invention, when a fitting portion of the machine proper and that of the sewing unit are formed with roundheaded columnar objects projecting from the connecting surface of the sewing unit and a cylindrical hole provided on the side of the machine proper in the same diameter as the columnar objects, it becomes possible to facilitate insertion of the sewing unit to the machine proper and to stabilize stitching work further while preventing loose connections. Further, it is possible to smooth the movement of getting the fitting portion of the sewing unit out.

It does not matter whether the machine proper to be used in the present invention is for lock stitching or over-lock stitching or cover hemming. However, if a machine proper which can perform plural modes of stitching is adopted and is provided with plural sewing units exchangeable for each other, it becomes possible to let one sewing machine perform different modes of stitching in accordance with the number of the sewing units and to display the advantage of the present invention to the full.

In the present invention, when a lock sewing machine is used as a machine proper and such machine proper is provided with a zigzag stitch actuation mechanism and connected to a lock stitch unit, it becomes possible to distinguish the mounting/detaching position of a lock stitch unit from the mounting/detaching position of other sewing units by arranging, for example, a fitting portion of an over-lock stitch unit or that of a covering hem unit, among the fitting portions to be provided at plural places on the connecting surfaces. They fit into a special fitting portion provided on the machine proper at a separate place from that of the fitting portion of the lock stitch unit. Thus, misinsertion can be avoided.

Further, the inside of a special fitting portion of the machine proper has a contacting element that is changeable in its position by the fitting of the fitting portion of the over-lock stitch unit or that of the flat stitch unit. The contacting element is linked through plural links with a control rod installed adjacent to a needle bar support which gives an amplitude to the needle. With a swing fixing means of the needle bar provided in such a way that the control rod is pulled with force by a spring which normally pulls in a direction of separation from the needle bar support, it becomes possible that, when over-lock stitching or cover hemming, the fitting portion of the sewing unit is pushed to resist the spring. The control rod moves forward to engage with the needle bar support, and the needle is fixed in order to not produce an amplitude. Thus, stable over-lock stitching or cover hemming can be carried out.

The swing fixing means can use its effect especially in the case of providing a lock sewing machine with a zigzag actuation mechanism in order to carry out both lock stitching and zigzag stitching and mounting an over-lock stitch unit or a covering hem unit onto the machine proper of such structure.

In the present invention, by providing the machine proper, which can use a lock stitch unit or an over-lock stitch unit in exchange for each other, with a needle which moves vertically, looking from the lateral direction of the sewing machine in accordance with lock stitching and zigzag stitching, and by inclining a fixing shaft of an upper looper of the over-lock stitching unit to about 200, it is possible to carry out lock stitching and zigzag stitching as smoothly as in the case of an ordinary lock stitching machine. In the case of over-lock stitching, it is also possible to carry out smooth over-lock stitching, because only the upper looper swings are inclined at a prescribed angle.

In the present invention, by extending a pivotal shaft toward the connecting surface of the machine proper as one body from the bottom end of a knife fixing feed bar provided in the over-lock stitch unit, and pivotally mounting onto the pivotal shaft the lower edge of a knife cover used combinedly as a cut waste removing chute with its upper side disposed along the outer side of a lower knife, and connecting the knife cover in such a way that it moves right and left as one body with the knife fixing feed bar, the knife cover comes close to the knife as much as possible, and the removal of cut waste is carried out exactly. Further, as the knife fixing feed bar and the knife cover move as one body, no interference with the knife happens.

In the present invention as designed above, when a front cover with a lower edge pivotally mounted onto the bed is provided adjacent to the right side of the knife cover, a pin provided on the upper right side of the knife cover is inserted into a guide groove formed on the left side of the front cover, and the knife cover is arranged to open and close as one body following the opening and closing of the front cover with the pivotal shaft as a fulcrum, threading work becomes easy when pulling a looper thread out of the thread guide.

In further accord with the present invention, an over-lock stitch unit has a supporting surface having an L-shaped section for freely slidably supporting a sliding portion on a side of a stitch width tongue for switching a rolled hem provided on the upper surface of the knife fixing feed bar in the sewing unit. A pressing plate guides the sliding portion of the stitch width tongue from both the open side and the upper side of the supporting surface and is fixed on the left side of the knife fixing feed bar. A fitting hole is provided on the sliding portion of the stitch width tongue, projecting in the rear of the pressing plate. A switching lever has an upper end fitted into a fitting hole and is pivotally mounted on the side of the knife fixing feed bar, An operational edge of the switching lever protrudes from this side of the over-lock stitch unit in a switchable state. With this arrangement there are advantages in that the stitch width tongue can be held exactly and firmly, and the switching operation of the rolled hem can be carried out simply on the front side of the sewing machine without being hindered by all the other elements.

In the sewing machine of the present invention designed to connected an over-lock stitch unit or a flat stitch unit, when the sewing unit is provided with a vertical bearing portion at a forward position along the connecting surface of said sewing unit, and the bearing portion is pivotally mounted onto a supporting shaft vertically installed at a forward position of the connecting surface of the machine proper, and the sewing unit is arranged to move to the other side of the bed when it is not used, it becomes unnecessary to take away the sewing unit, which is larger in size than the lock stitch unit, when exchanging it for the other sewing unit. Further, when it is used the next time, it can be connected to the machine proper by turning it with the supporting shaft as a fulcrum. Thus, the labor for mounting and detaching the sewing unit can be lightened.

The present invention is provided with an over-lock stitch unit, a covering hem unit and a lock stitch unit. It is designed to fit the fitting portion of the over-lock stitch unit and that of the covering hem unit into the fitting portion of the machine proper at a place separate from the fitting portion of the lock stitch unit. It is provided with a contacting element inside of the special fitting portion, linking it through a plural number of links with a control rod installed adjacent to the needle bar support. It is also provided with a swing fixing means of the needle bar that is designed not to give an amplitude to the needle at the time of over-lock stitching or cover hemming. If a shifter is interposed between a zigzag guide and a zigzag lever provided in the machine proper and one of the above-mentioned links is made to engage with the shifter, and a zigzag actuation clutch is provided so that a swing of the zigzag lever is not transmitted to the zigzag guide plate when over-lock stitching or cover hemming, the liaison between the needle bar support and the zigzag actuation means is cut off by the clutch. Thus, over-lock stitch or covering hem can be carried out stably.

DETAILED DESCRIPTION OF THE PREFERRED EMBODIMENTS

Figure 1:
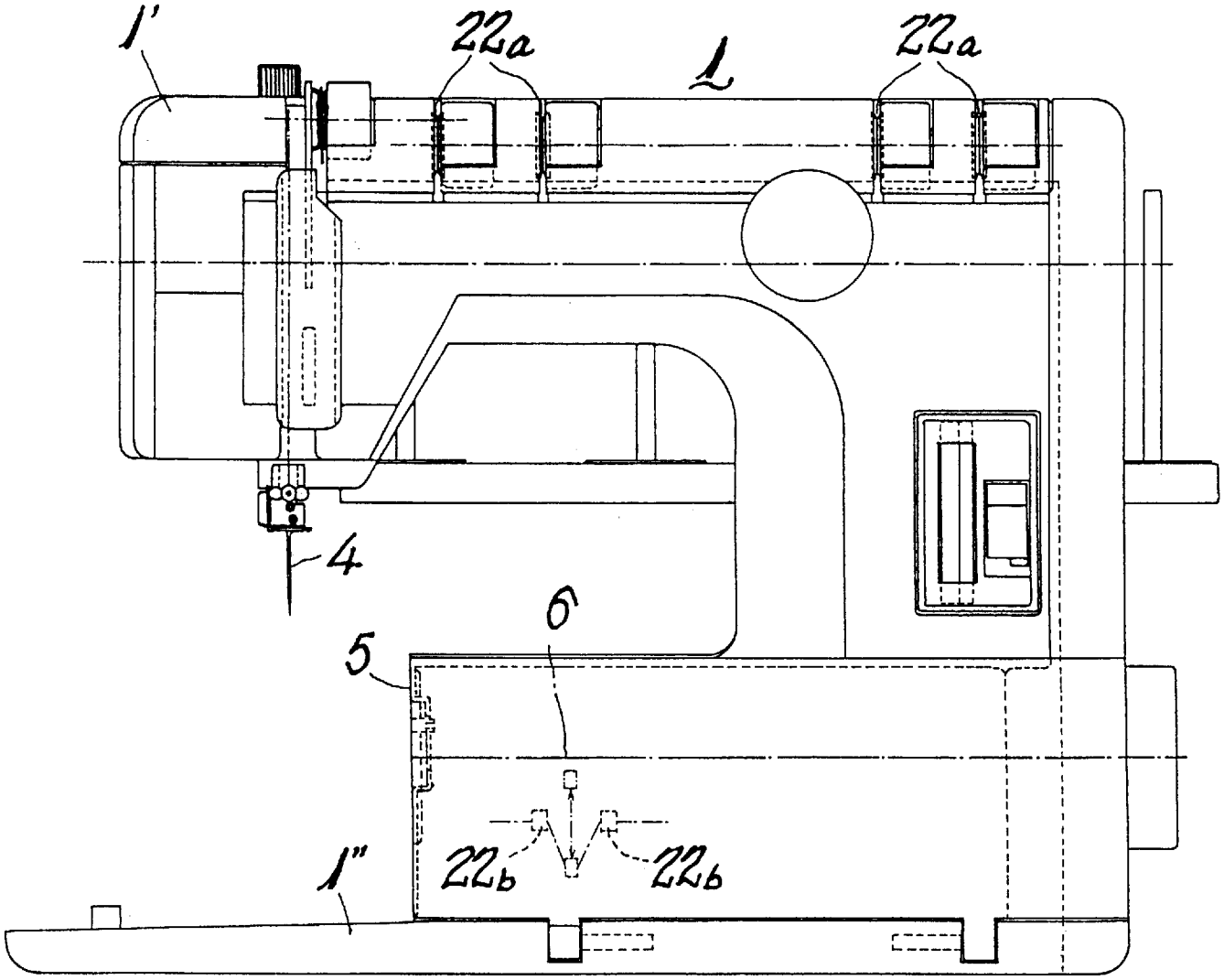
FIG. 1 is a front view of a machine proper showing working example 1 of the present invention.
Figure 2:
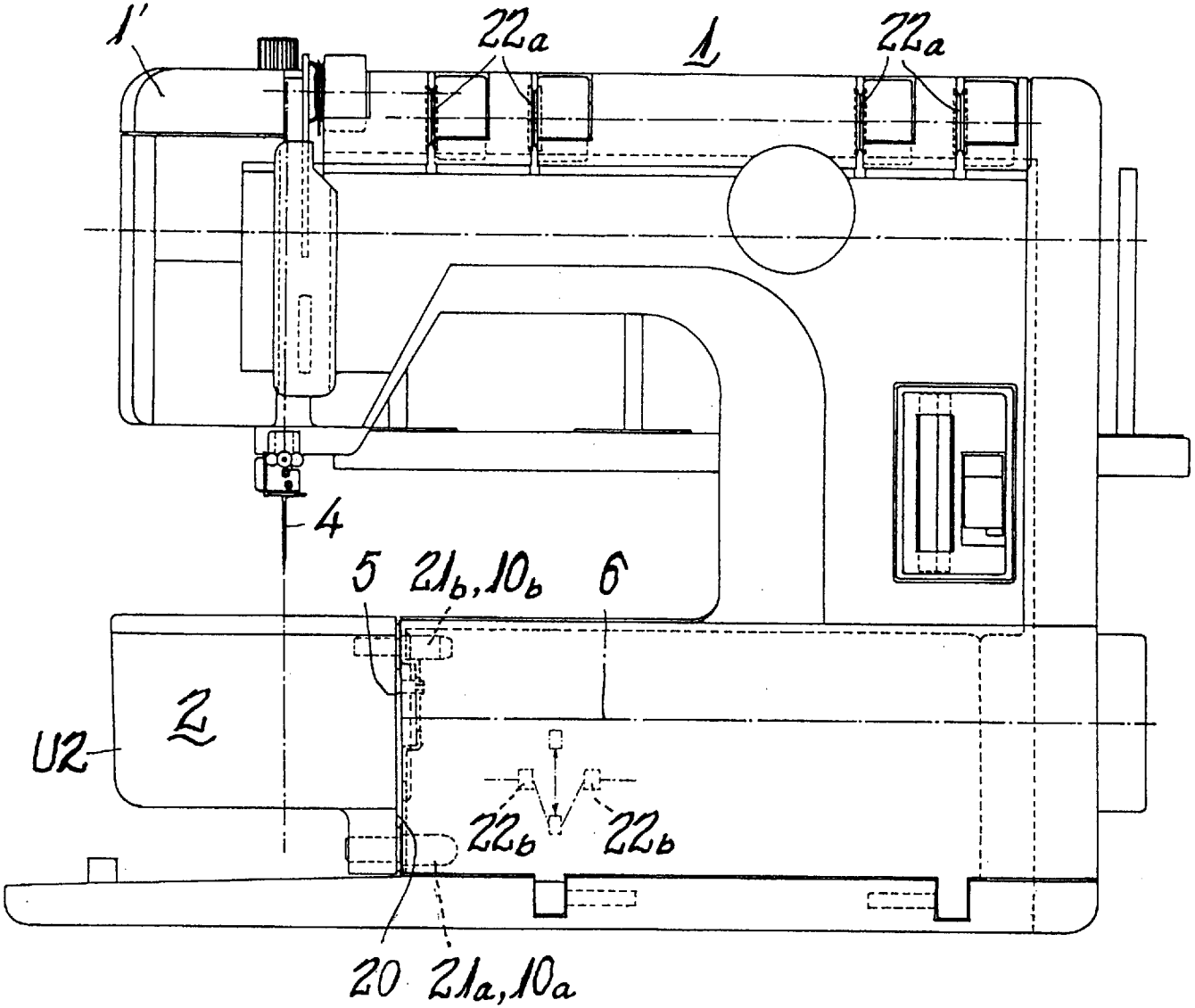
FIG. 2 is a front view in the case of connecting a lock stitch unit.
Figure 3:
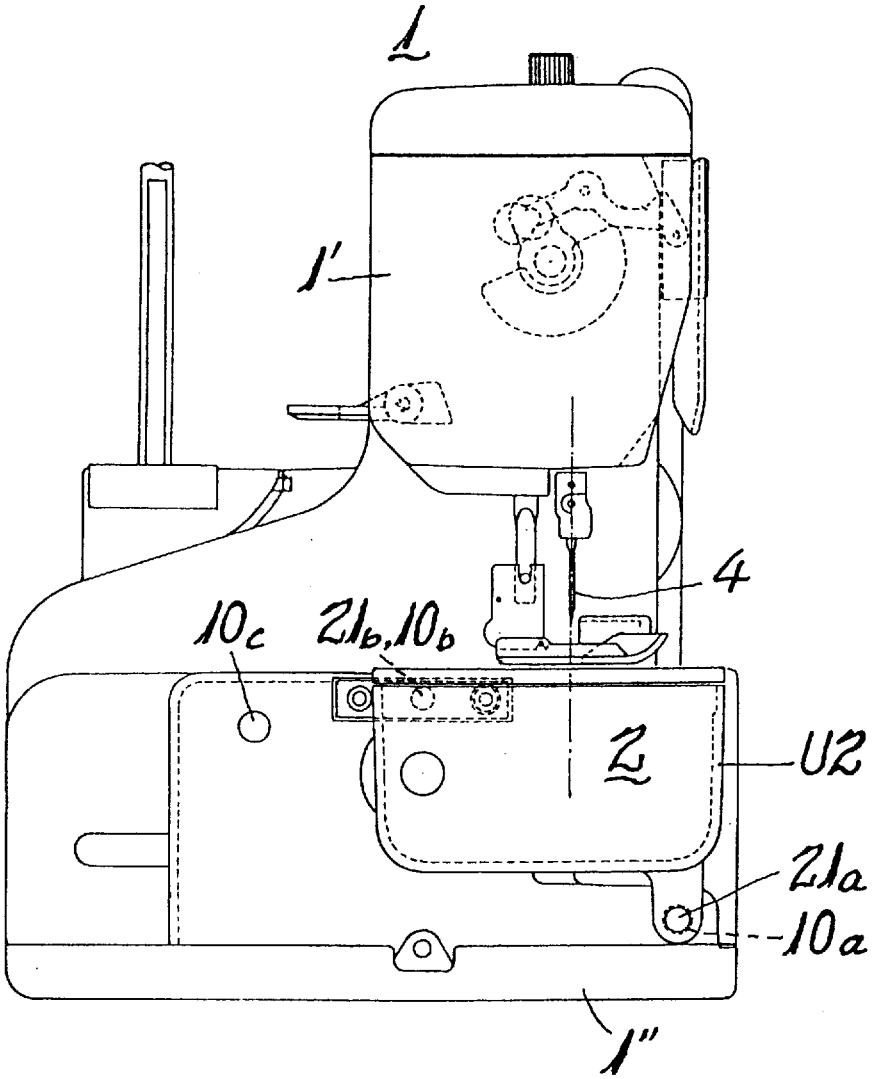
FIG. 3 is a left-hand side view in the case of connecting a lock stitch unit.

In the working example 1 shown in FIGS. 1–20, a machine proper 1 is formed, as shown in FIG. 1, by cutting off a left-end portion of a bed 1" vertically at a place appropriately biased to the right from a rise-and-fall position of a needle 4, leaving the cut-off side as a connecting surface 5.

On the connecting surface 5, as shown in FIGS. 4–7, are exposed at least a shaft coupling 7*a* of a lower shaft 6, a shaft coupling 9*a* of a feed control shaft 8, plural fitting portions 10*a*, 10*b*, and 10*c* to be fitted by two sewing units 2, 3 and a combining portion 11*a* of a combining means 11 to be combined with the sewing units 2, 3 in such a way that they can be mounted on and detached from their counterpart elements.

Figure 4:
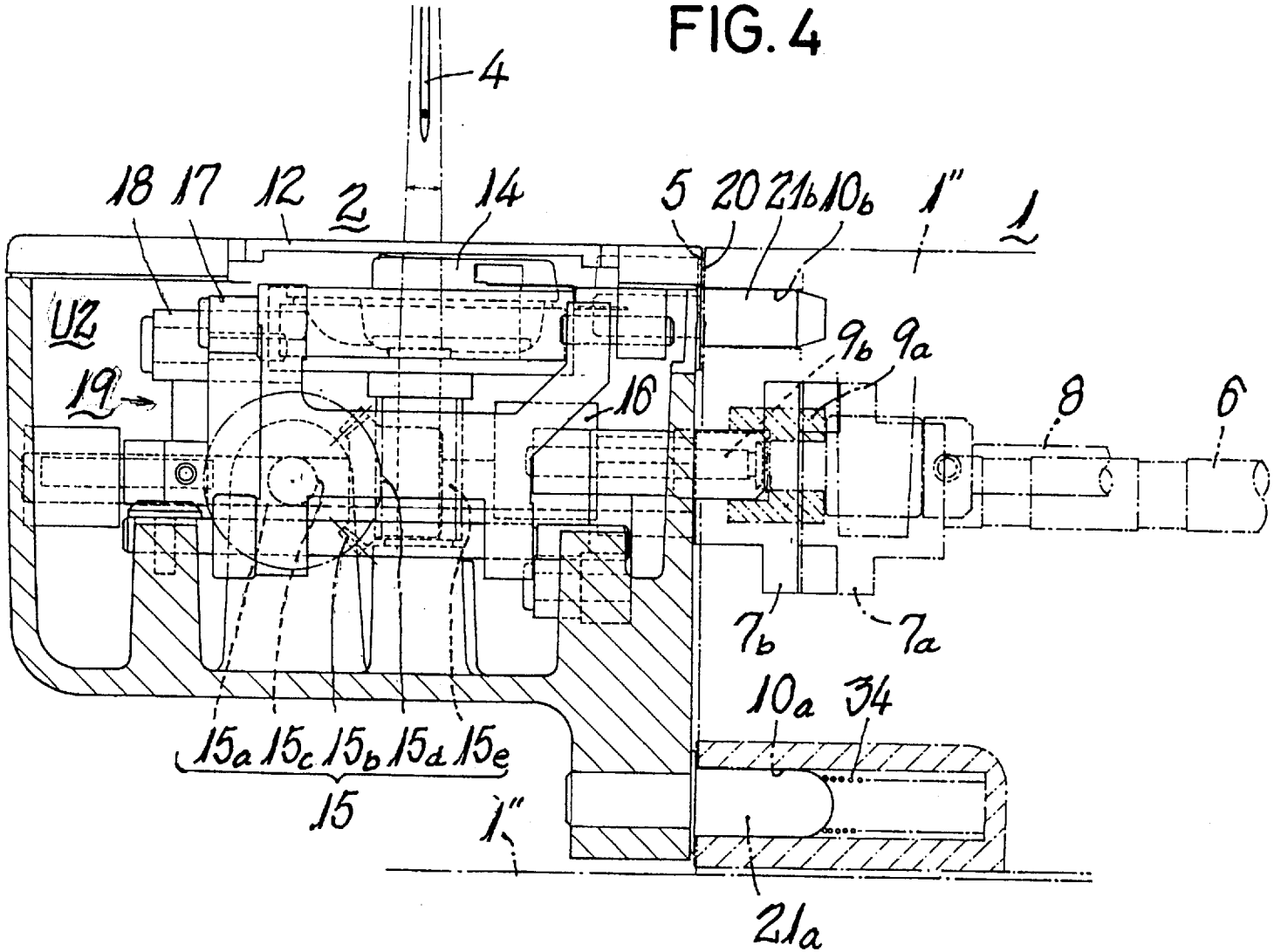
FIG. 4 is a partially cutaway front view showing the inside structure of the lock stitch unit.
Figure 6:
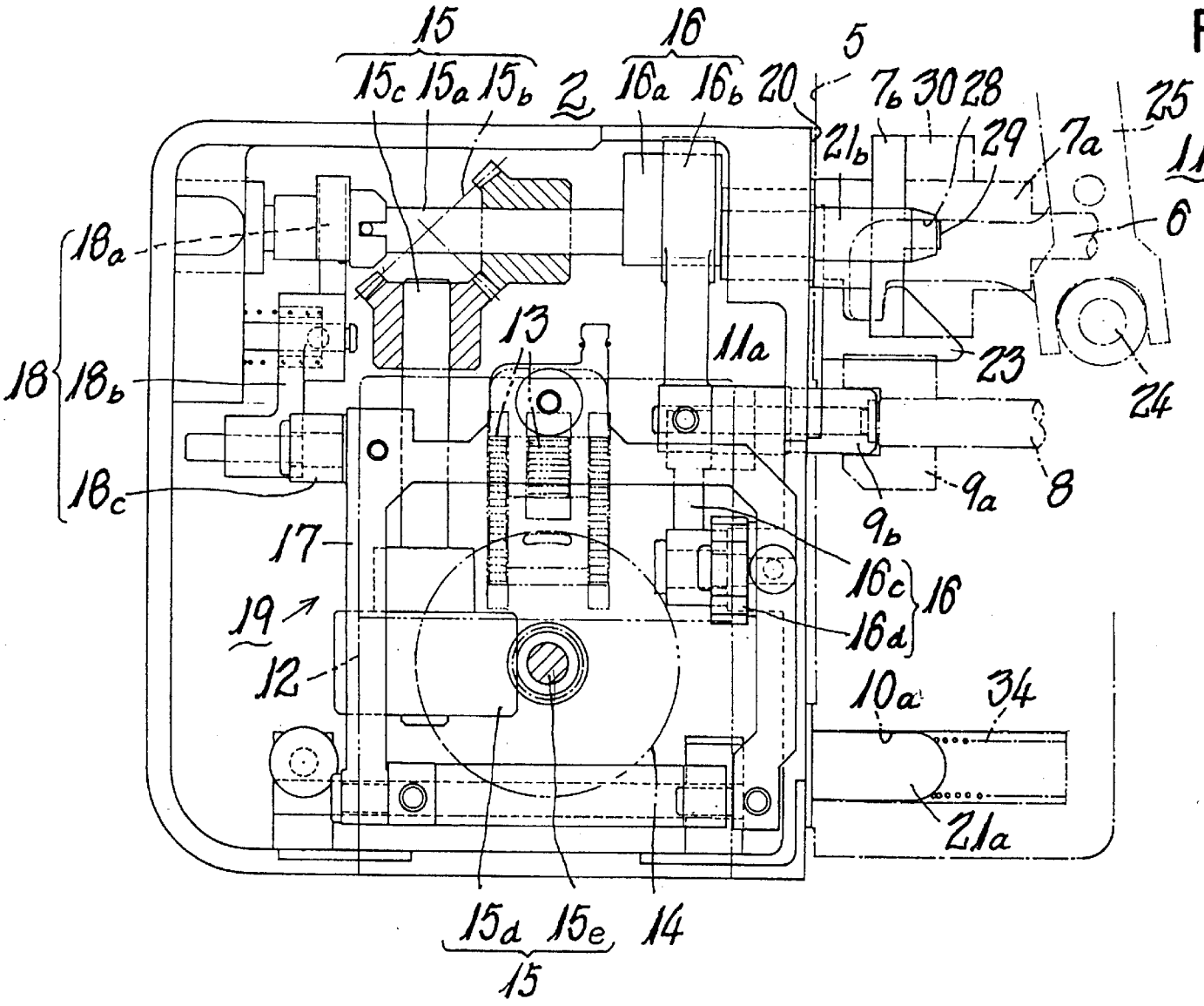
FIG. 6 is a partially cutaway plane view showing the inside structure of the lock stitch unit.

The unit 2 is a lock stitch unit, and as shown in FIGS. 4 and 6 has a needle plate 12 and feeding teeth 13 on its upper surface, and also has, on the back of the needle plate 12, a shuttle portion 14 where a shuttle of a horizontally rotative type (omitted in the Drawing) is installed. It is provided with a shuttle driving mechanism 15 composed of a rotary shaft 15*a* having on its one end a shaft coupling 7 for engaging with a shaft coupling 8*a* of the lower shaft 6, a bevel gear transmitting mechanism 15*b*, an intermediate shaft 15*c*, a spiral gear mechanism 15*d* and a vertical shaft 15*e*.

Figure 5:
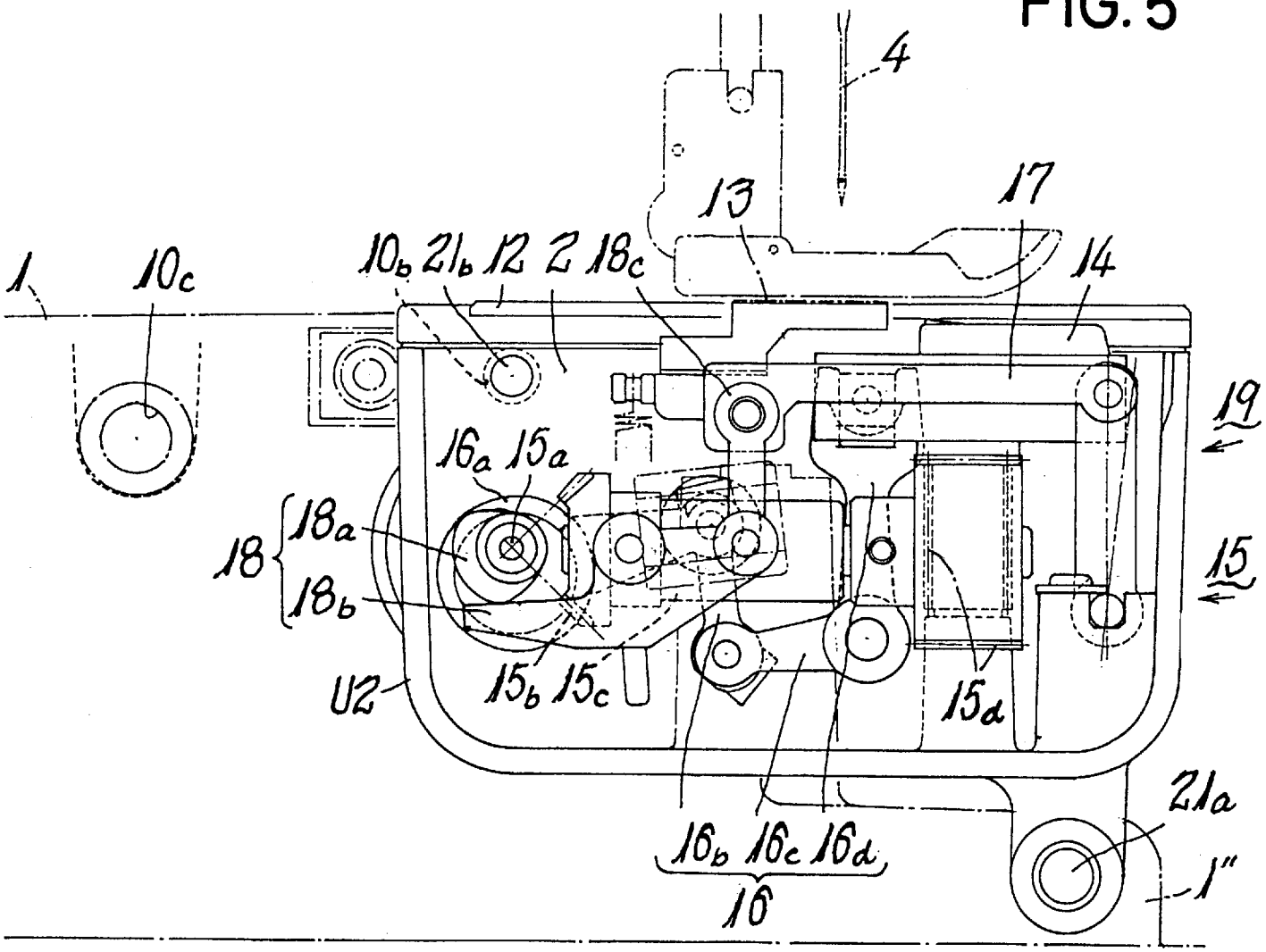
FIG. 5 is a partially cutaway side view showing the inside structure of the lock stitch unit.

As similarly shown in FIGS. 4, 5, 6, the lock stitch unit 2 has set in it a cloth feeding mechanism 19 which is constituted by:

a horizontal feeding mechanism 16 composed of a cam 16*a* fixed to a rotary shaft 15*a*, a swing rod 16*b*, a horizontal feed arm 16*c* which fits a shaft coupling 9*b* combinedly used as a feed regulator hinge pin into a shaft coupling 9*a* combinedly used as a feed regulator on the top end of a feed control shaft 8 and which connects the other end to the swing rod 16*b*, and a forked rod 16*d* provided between the horizontal feed arm 16*c* and a feeding bar 17 to perform a horizontal feed of the feeding teeth 13; and a vertical feeding mechanism 18 composed of a swing rod 18*b* to be swung by a cam 18*a* fixed to the rotary shaft 15*a* and a linking rod 18*c* which is connected to the swing rod 18*b* and to the top of the feeding bar 17 and which converts a swing of the swing rod 18*b* to a vertical movement of the feeding bar 17.

In a unit body U2 housing the lock stitch unit 2 as shown in FIGS. 4, 6, its right side is formed into a connecting surface 20 to the machine proper 1. Front and rear fitting portions 21*a* and 21*b* protrude on the connecting surface 20 and are fitted into fitting portions 10*a*, 10*b* of the machine proper 1. A combining portion 23 of a backward motion stopping tooth shape protruded similarly on the connecting surface 20 engages with a combining portion 11*a* of a combining means 11 of the machine proper 1. Thus, the machine proper 1 and the lock stitch unit 2 are combined with each other as one body.

Figure 7:
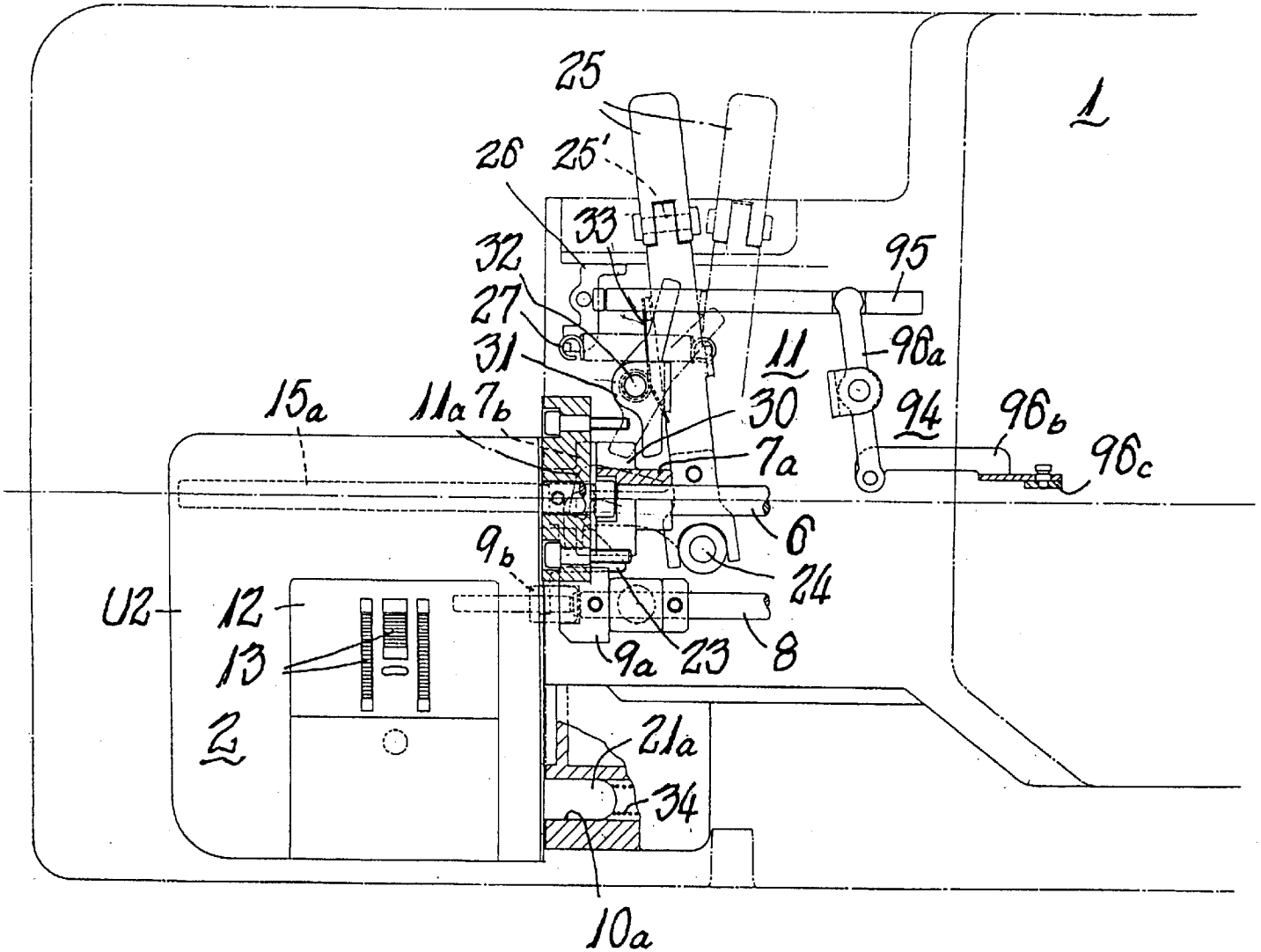
FIG. 7 is a partially cutaway plane view in the case of connecting a lock stitch unit.

The combining means 11 as shown in FIG. 7 is composed of:

an operation lever 25 which links its top end with the combining portion 11*a* formed into a hook-shape so as to engage with the combining portion 23 of a backward motion stopping tooth shape of the lock stitch unit and which is held in a horizontally swinging free state through a fulcrum shaft 24, it exposes its bottom end on the outer side of the other side of the bed 1" so as to be bendable at a lateral shaft 25'; and a traction spring 27 which has its one end hung on a spring support 26 fixed inside of the bed and its other end on the side edge of the operation lever 25 for pulling the operation lever 25 always in a direction of combination.

When connecting the lock stitch unit 2 to the machine proper 1, the combining portion 23 of a backward motion stopping tooth shape elastically passes the top of the hook-shaped combining portion 11*a*, pulled with force by the traction spring 27 and engages with the combining portion 11*a* and presses the lock stitch unit firmly to the machine proper 1 by the traction Among plural fitting portions 10*a*, 10*b*, 10*c* of the machine proper 1, the fitting portion 10*a* provided on the side of the bed, as shown in FIGS. 4, 6, and 7, is a cylindrical hole with a bottom deeper than the other fitting portions, and is provided with a coil spring 34 supported on the bottom. The fitting portion 21*a* of the lock stitch unit to be fitted into the fitting portion 10*a* is formed into a column of the same diameter.

When moving the operation lever 25 of the combining means 11 in an open state, the coil spring 34 pushes out the fitting portion 21*a* of the sewing unit by its force and causes the connecting surface 20 of the lock stitch unit 2 to separate from the connecting surface 5 of the machine proper 1.

Figure 8:
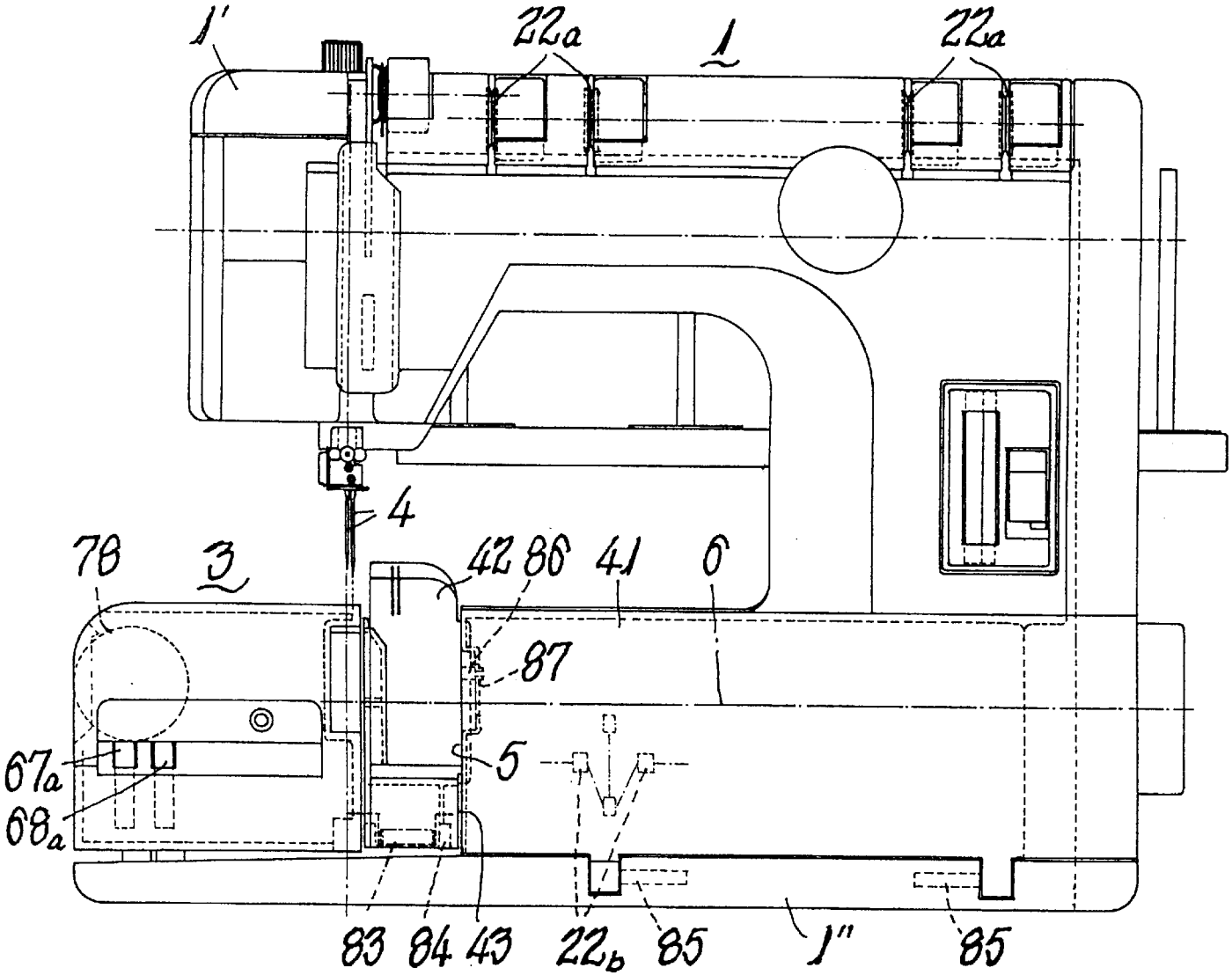
FIG. 8 is a front view in the case of connecting an over-lock stitch unit.
Figure 9:
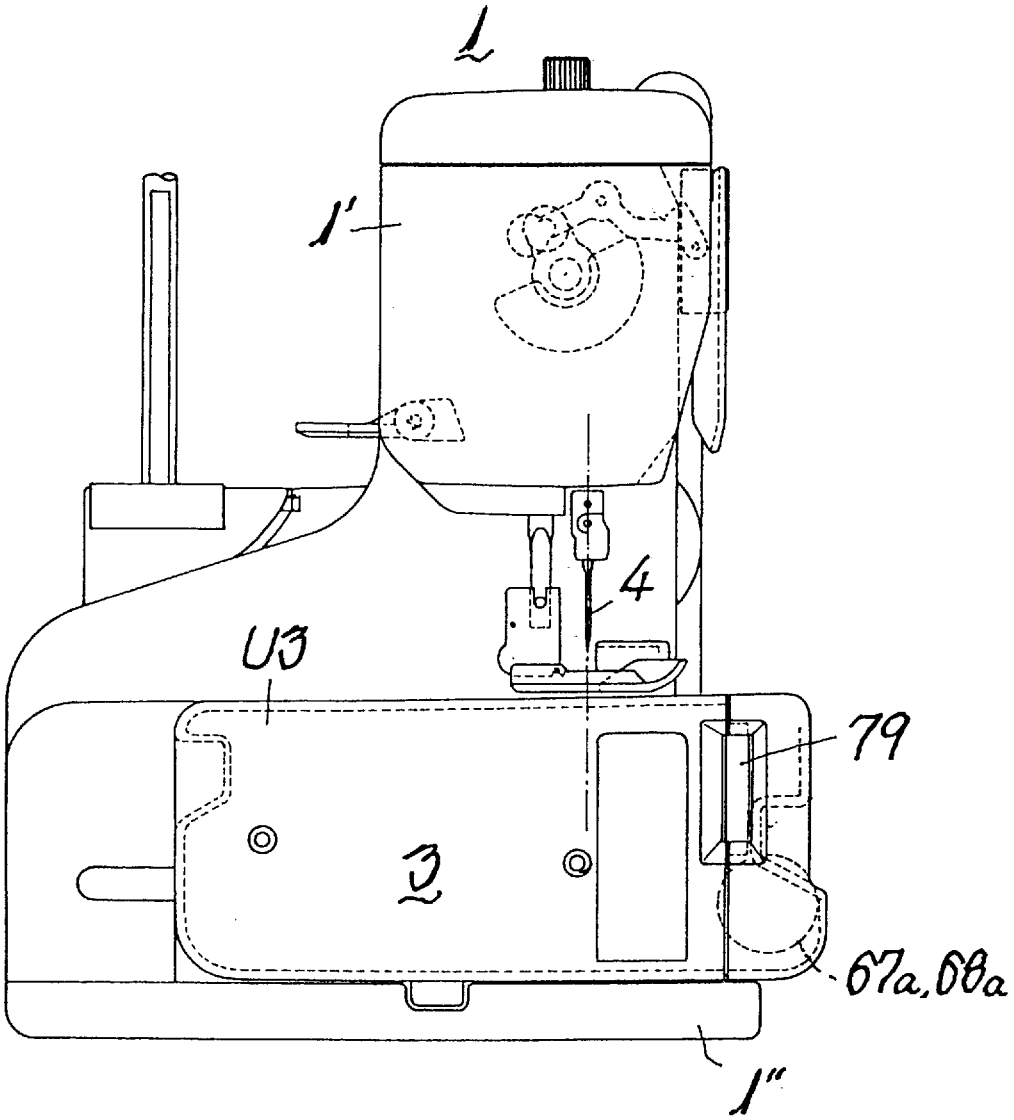
FIG. 9 is a side view in the case of connecting an over-lock stitch unit.
Figure 10:
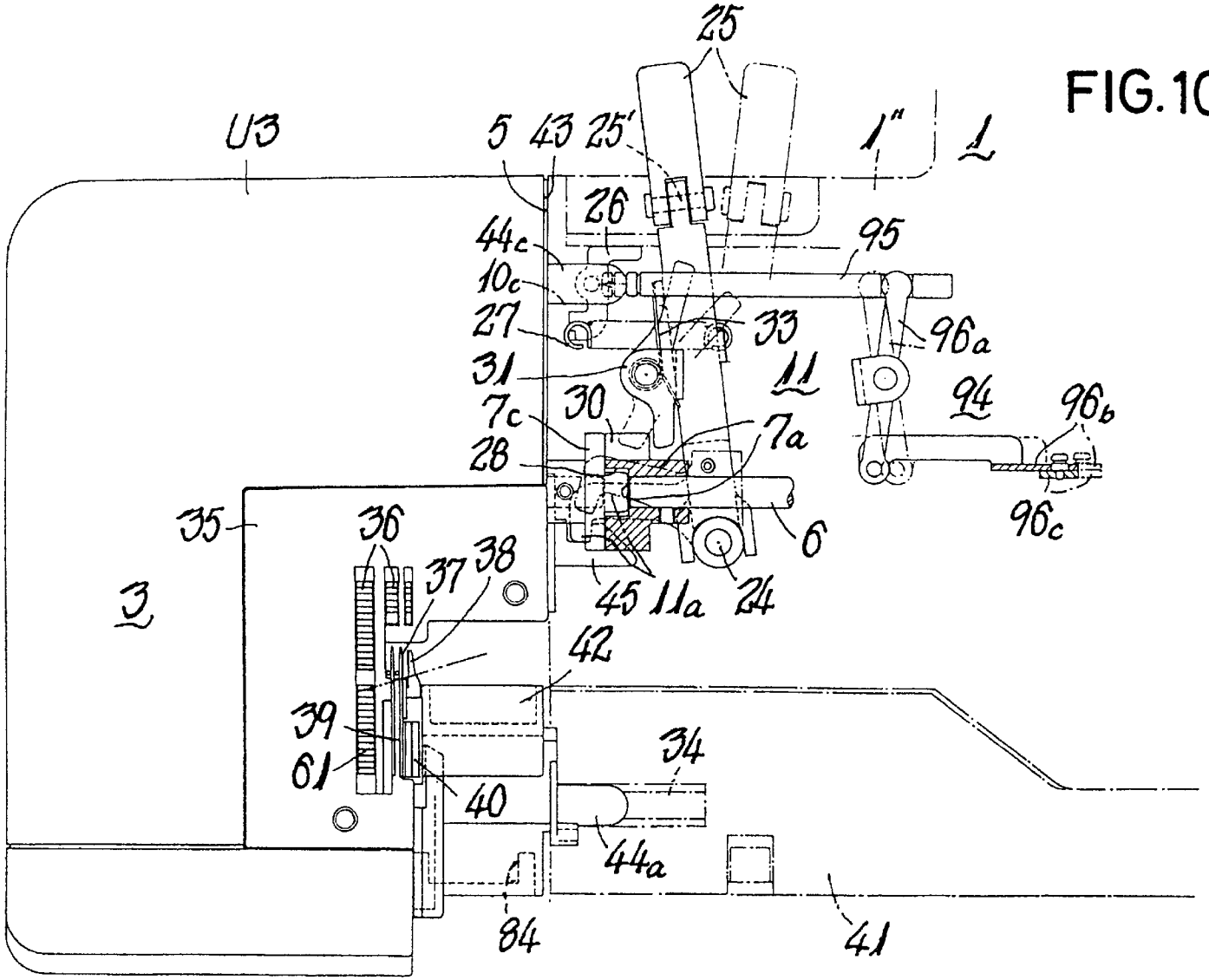
FIG. 10 is a partially cutaway plane view in the case of connecting an over-lock stitch unit.

Next, an explanation will be given about the over-lock stitch unit 3, which is connected similarly to the connecting surface 5 of the machine proper 1 as shown in FIGS. 8, 9, 10 so that it can be freely mounted on and detached from the machine proper 1 and exchanged for the lock stitch unit 2.

The over-lock stitch unit 3, as shown in FIG. 10, is provided with a needle plate 35 for over-lock stitching on the upper surface of a unit body U3. Feeding teeth 36 are exposed in the needle plate 35, and on the right of the needle plate 35 are exposed a needle plate tongue 37 for a rolled hem, a stitch width tongue 38 for switching the rolled hem, a stable knife 39 disposed on its lower side, and a movable knife 40 disposed on its upper right side.

Further, the sewing unit is provided with a knife cover 42 that is combinedly used as a cut waste removing chute adjacent to the movable knife 40 between the knife 40 and a front cover 41 covering this side of the bed 1" of the machine proper 1.

Further, as shown similarly in FIG. 10, the over-lock stitch unit 3 forms its right side surface into a connecting surface 43 to the machine proper 1. Two fitting portions 44*a* and 44*c* to fit into the fitting portions 10*a* and 10*c*, which portion 10*c* is not used in the case of the lock stitch unit 2. Disposed at about the middle of the connecting surface 43, in a protruded state, is a fitting portion 45 having a backward motion stopping tooth shape. It is combined with the combining portion 11*a* of the combining means 11, and thereby, similar to the case of the lock stitch unit 2, it is fitted into the machine proper 1 and pressed to combine as one body.

In the over-lock stitch unit 3, as shown similarly in FIG. 10, a shaft coupling 7*c* protruding from the connecting surface 43 is fitted into the shaft coupling 7*a* of the machine proper 1. A rotary shaft 46 to be linked with the lower shaft 6 by the engagement between the groove 28 and the protruded strip 29 formed on the mutual connecting surfaces, like the case of the lock stitch unit 2, and to be transmitted rotation, is installed in the unit body U3 in a rotation free state as shown in FIG. 11.

Figure 11:
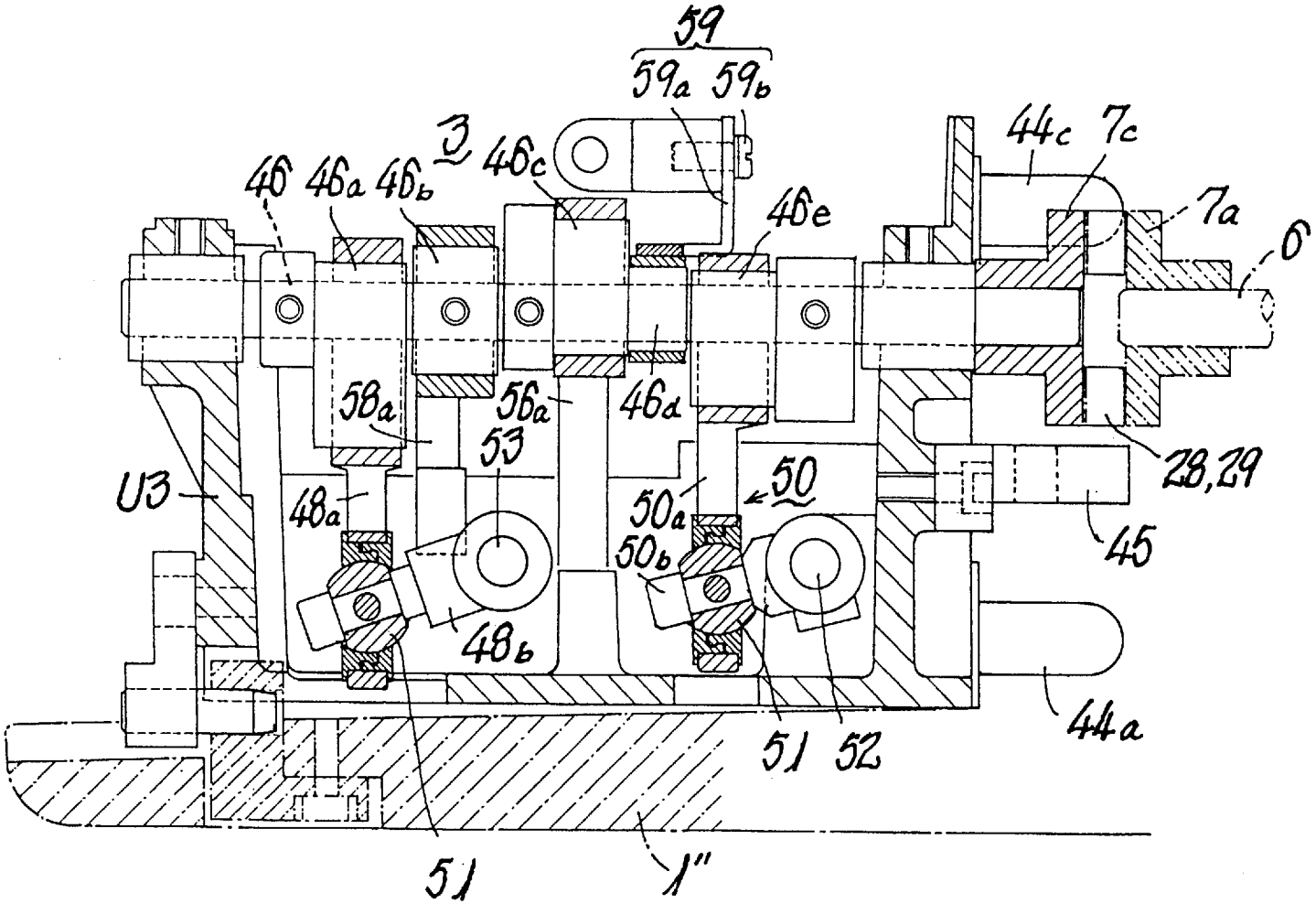
FIG. 11 is a partially cutaway front view showing the inside structure of the over-lock stitch unit.

The rotary shaft 46 has five cams fixed thereon including, in order from the left in FIG. 11, an upper looper cam 46*a*, a horizontal feed cam 46*b*, a knife cam 46*c*, a vertical feed cam 46*d* and a lower looper cam 46*e*. The rotary shaft 46 becomes a prime shaft for driving a looper driving mechanism, a knife driving mechanism, a cloth feed driving mechanism and a later mentioned differential cloth feed mechanism, all installed in the unit body U3.

Figure 12:
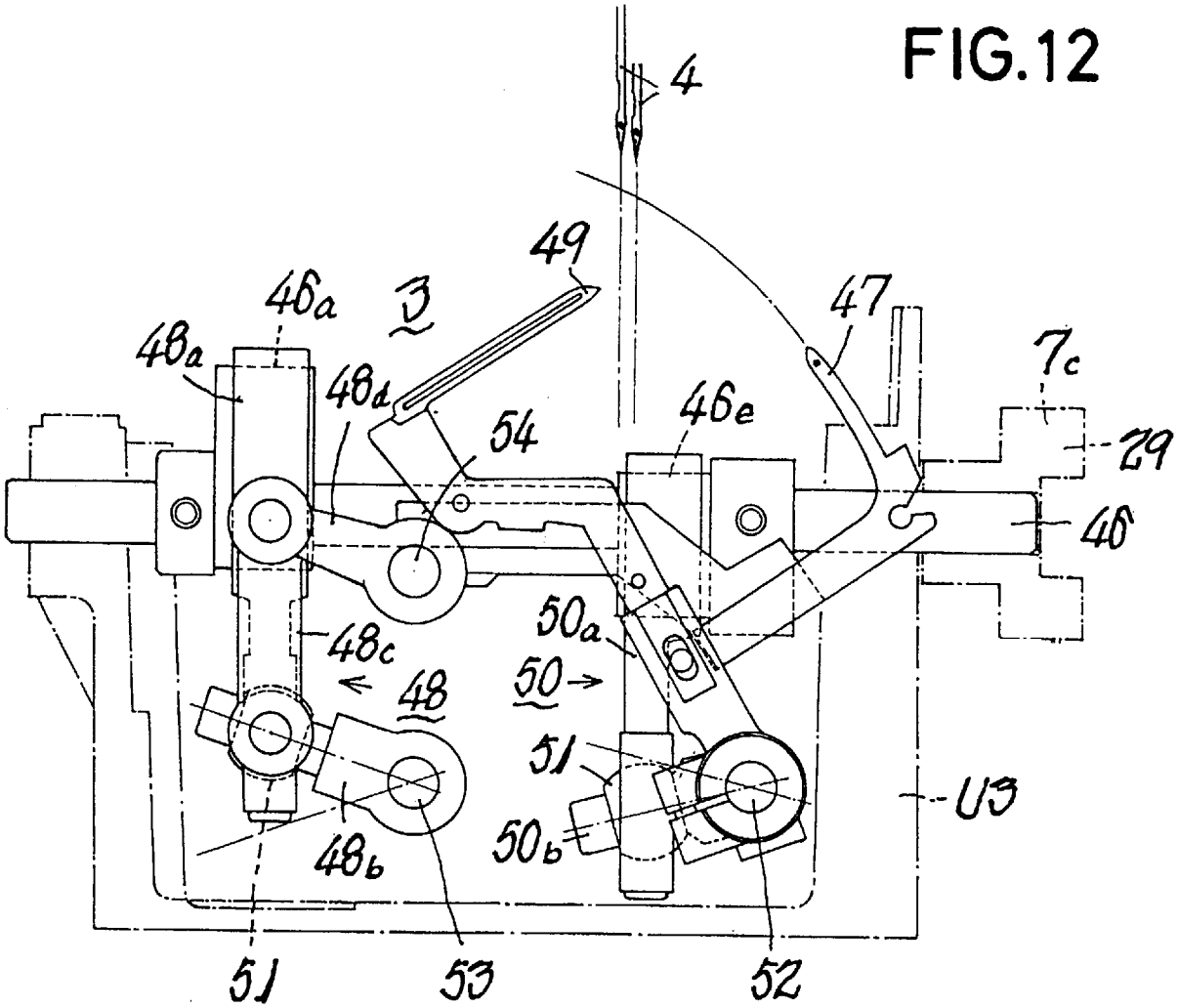
FIG. 12 is a partially cutaway front view showing a portion of a looper mechanism.

As shown in FIGS. 11 and 12, an upper looper 47 is provided with an upper looper driving mechanism 48, composed of the upper looper cam 46*a*, a cam link 48*a*, a lower swing arm 48*b*, a rise-and-fall rod 48*c* and an upper swing lever 48*d*. A lower looper 49 is provided with a lower looper driving mechanism 50, composed of the lower looper cam 46*e*, a cam link 50*a* and a swing lever 50*b*. The two loopers perform a prescribed swing motion crossing each other on the back of the needle plate 35 while holding the rise-and-fall position between them, similarly to the case of the conventional, publicly-known over-lock sewing machine.

By means of connecting respective spherical couplings 51 between the top of the lower swing arm 48*b* of the upper looper driving mechanism 48 to the top of the cam link 48*a*, and between the top of the swing lever 50*b* of the lower looper driving mechanism 50 to the top of the cam link 50*a*, a vertical swing of the cam link 48*a* and the cam link 50*a* is converted into a later swing of the upper looper 47 and the lower looper 49.

Further, a fixing shaft 52 of the lower looper 49, to fix the base of the swing lever 50*b* as one body, is horizontally supported. A fixing shaft 54 of the upper looper 47 inclines together with a pivotal shaft 53 of the lower swing arm 48*b* about 20° from horizontal as shown in FIG. 13, and the upper looper 47 inclines about 20° against the perpendicular as shown similarly in FIG. 13.

Figure 13:
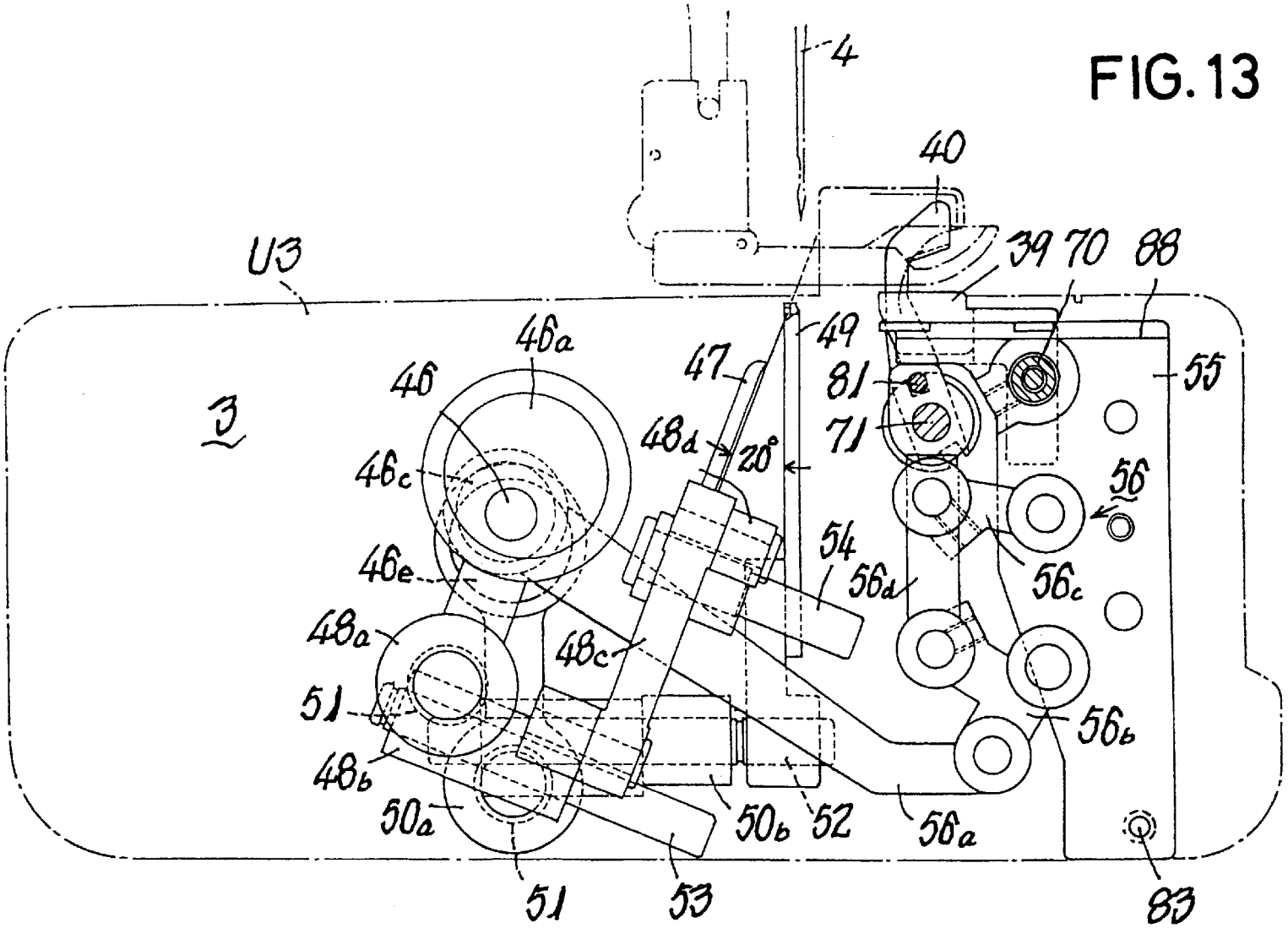
FIG. 13 is a partially cutaway side view showing a portion of a looper mechanism and a portion of a knife table.

It is advantageous performing a lock stitching to provide the needle 4 which moves vertically to the needle plate 35 as shown in FIG. 13.

It is also advantageous for smoothing over-lock stitching and for facilitating the manufacture of a sewing machine to incline the fixing shaft 54, and thereby incline the upper looper 47, about 20° with respect to the needle 4. In the case of a sewing machine having the machine proper designed for lock stitching and over-lock stitching, especially, this facilitates manufacture of the machine and smoothes the two modes of stitching. Thus, it becomes easy to use and hard to break.

As shown similarly in FIG. 13, the movable knife 40 is mounted on an upper part of a side of a knife fixing feed bar 55 disposed on this side of the connecting shaft 43 in a laterally slide free state in the unit body U3.

The movable knife 40 is provided with a knife driving mechanism 56 composed of a knife cam 46*c*, a cam link 56*a*, and a pair of upper and lower swing arms 56*b* and 56*c* mounted on the left side of the knife fixing feed bar 55, and a rise-and-fall link 56*d* connected between the upper and lower swing arms to convert a swing of the cam link 56*a* to a rise-and-fall movement of the movable knife 40.

Figure 14:
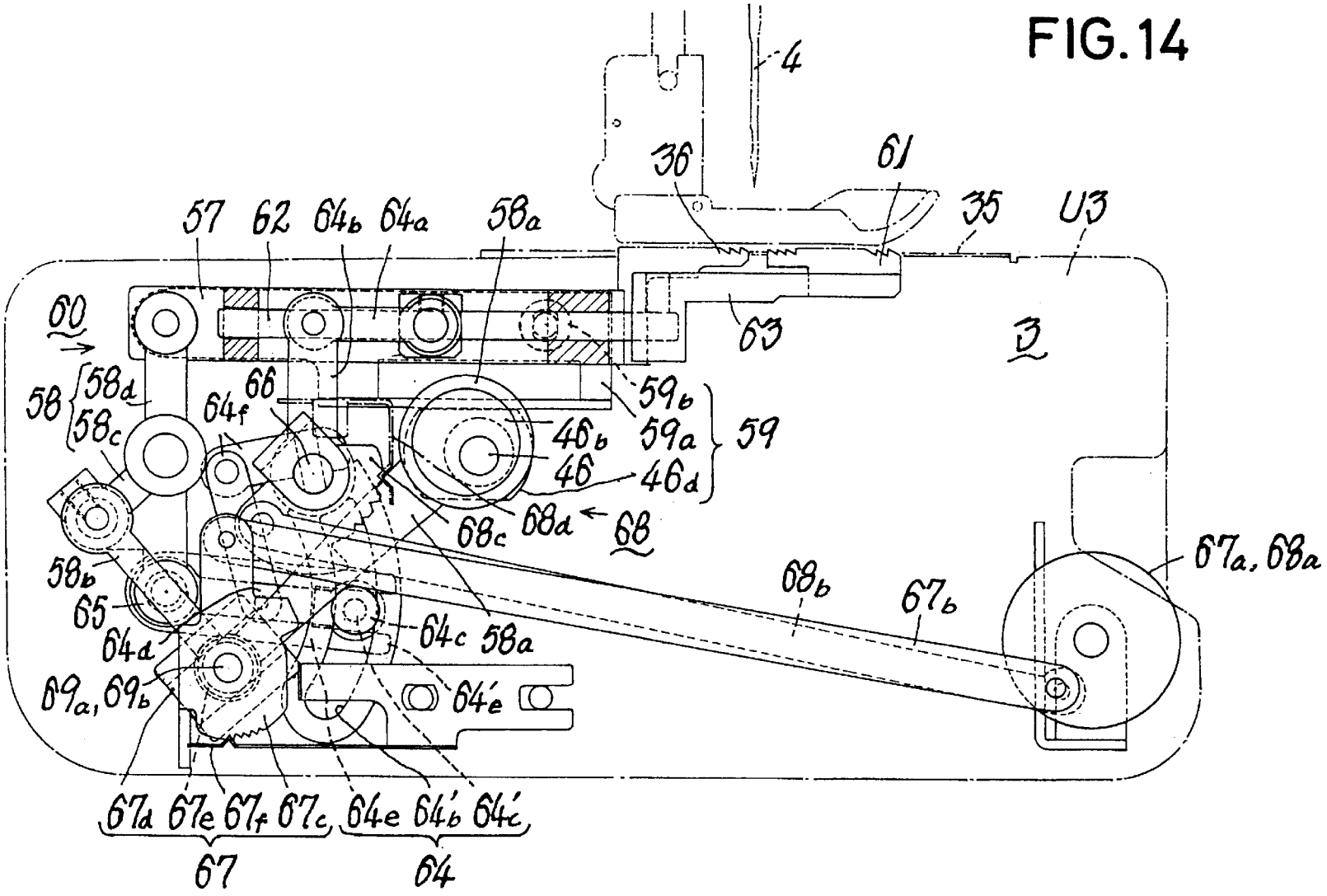
FIG. 14 is a partially cutaway side view showing a portion of a cloth feed mechanism of the over-lock stitch unit.

As shown in FIG. 14, a feeding bar 57 provided with the feeding teeth 36 is driven by a cloth feeding mechanism 60 constituted by:

a horizontal feed mechanism 58 composed of a horizontal feed cam 46*b*, a cam link 58*a*, a swing link 58*b* linked at its bottom end with the cam link 58*a*, a bent-shaped lever 58*c* linked at its bottom end with the top of the swing link 58*b*, and a swing lever 58*d* which links the lever 58*c* with the front end of the feeding bar 57 to convert a swing of the bent-shaped lever 58*c* to a horizontal feed of the feeding bar 57; and a vertical feed mechanism 59 composed of, as shown in FIGS. 11 and 14, a link plate 59*a* having an L-shape section and moving up and down while getting its lower surface in touch with the vertical feed cam 46*d* from above, and a linking screw 59*b* to be screwed from the side of the link plate 59*a* to the side of the center of the feeding bar 57 to transmit a rise-and-fall movement of the vertical feed cam 46*d* to a vertical movement of the feeding bar 57.

Further, as shown in FIGS. 10 and 14, and over-lock stitch unit 3 is provided with differential feed teeth 61 at a certain distance on this side of the feeding teeth 36 so that it can control a feeding amount of cloth for sewing.

Figure 15:
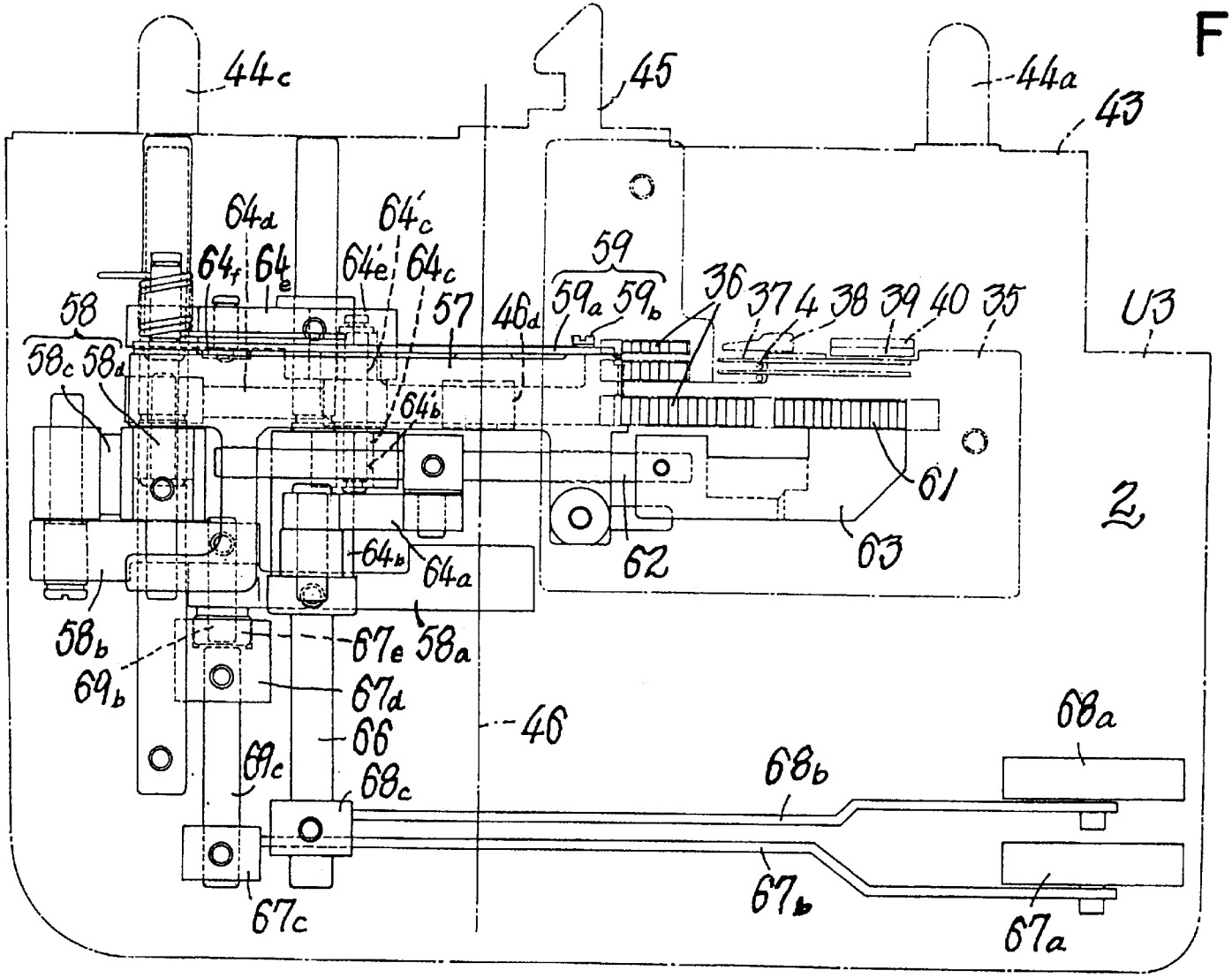
FIG. 15 is a partially cutaway plane view showing the inside structure of the over-lock stitch unit.

As shown in FIGS. 14 and 15, the differential feed teeth 61 are supported through a fixing element 63 by the top of a supporting shaft 62 inserted in a slide free state into the left side of the feeding bar 57 in parallel with the feeding bar 57.

The supporting shaft 62 is provided with a differential horizontal feed mechanism 64 composed of a connecting link 64*a* and a swing lever 64*b* linking its top end with the connecting link 64 and hanging down. A swing link 64*d* having its bottom end pivotally mounted on the lower end of a forked rod 65 extending under the bent-shaped lever 58*d* and having a fitting element 64*c* of its top end fitted into a circular-arc-shaped hole 64*b*' for controlling the amount of feeding provided at a lower part of the swing lever 64*b*. A swing arm 64*e* is fitted into the other end of a supporting shaft 64*c*' of the fitting element 64*c* into a forked portion 64*e*'. A link 64*f* has two joints and connects a fulcrum shaft 66 fixing the swing lever 64*b* to the middle of the swing link 64*d*. The differential feed teeth 61 are fed, horizontally linking with the swing of the bent-shaped lever 58*d* in the horizontal feed mechanism 58 of the feeding teeth 36.

A cloth feed control mechanism 67 for controlling the amount of cloth feed by the feeding teeth 36 is composed of an operation dial 67*a* that exposes its circumference on the side of the over-lock stitch unit 3 as shown in FIG. 14 and a link rod 67*b*. A swing bracket 67*c* pivotally supports the top of the link rod 67*b* on its upper end, being fixed to the bottom of a cloth feed control shaft 69*a*. A feed regulator 67*d* is fixed to the top of the cloth feed control shaft 69*a*, a fitting element 67*e* is fixed to one end of a connecting shaft 69*b* connecting a cam link 58*a* for horizontal feed to the swing link 58*b* and fitted into the feed regulator 67*d* to set the amount of horizontal feed, and a click spring 67*f* to fix the inclining position of the swing bracket 67*c*. By changing the angle of the swing bracket 67*c*, the range of swing to be transmitted from the cam link 58*a* to the swing link 58*b*, i.e. the amount of cloth feed, can be controlled.

A differential feed control mechanism 68 is installed in line with the cloth feed control mechanism 67 and is composed of an operation dial 68*a* that exposes its circumference on the side of this side of the over-lock stitch unit 3, a link rod 68*b*, a swing bracket 68*c* pivotally supporting the top of the link rod 68*b* on its back side and being fixed as one body to a fulcrum shaft 66 of the swing lever 64*b* for differential horizontal feeding, and a click spring 68*d* to fix an inclining position of the swing bracket 68*c*. By changing the inclining position of the swing bracket 68*c* and the swing lever 64*b* through the operation dial 68*a* and the link rod 68*b*, the fitting element 64*b*' for controlling the amount of feeding and the swinging range of the swing lever 64*b* is changed and the amount of differential cloth feed is controlled.

Figure 16:
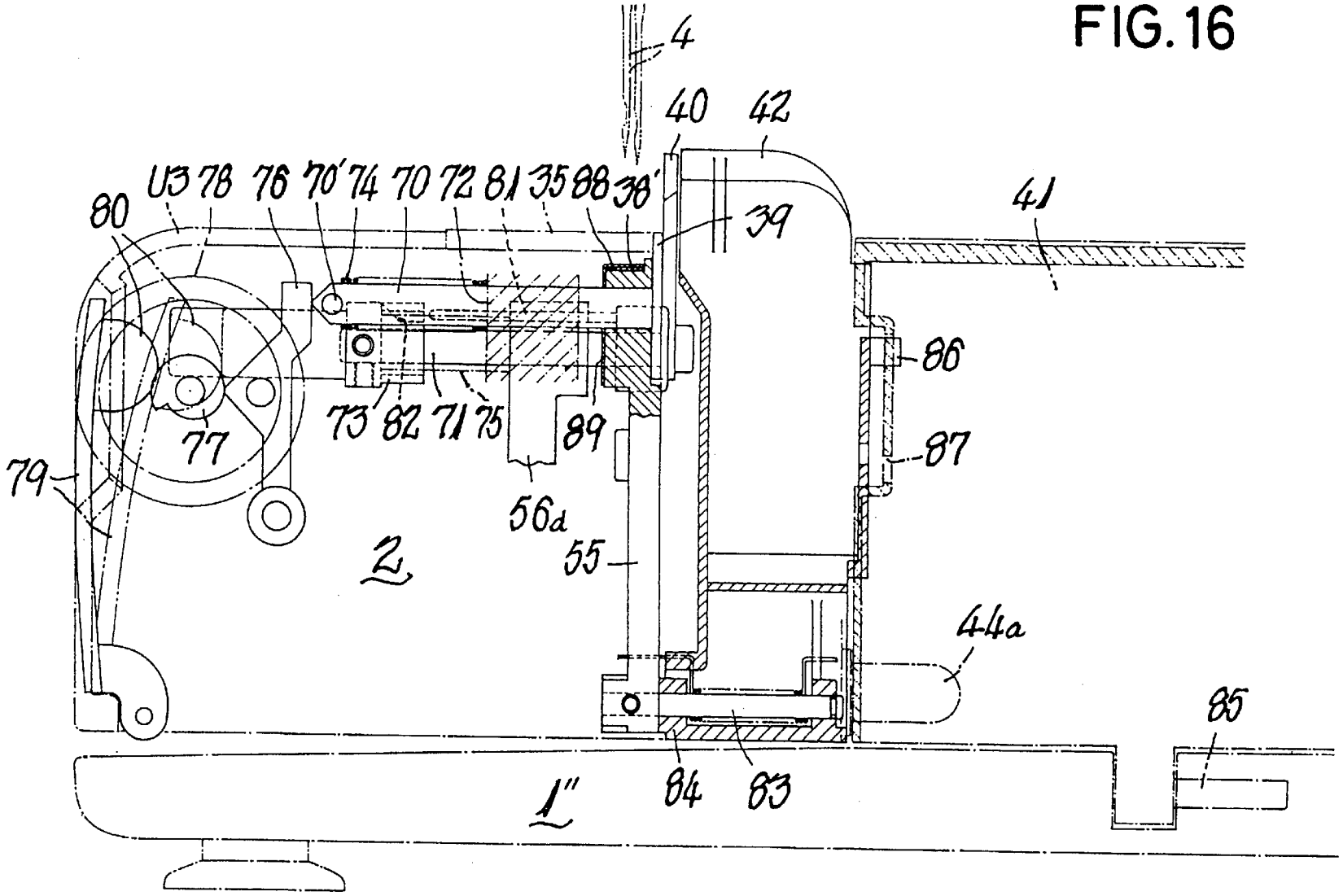
FIG. 16 is a partially cutaway front view showing a knife table and a knife cover combined as a cut waste remover.

As shown in FIG. 16, the knife fixing feed bar 55 is designed to let a stable knife shaft 70 pass sideways through a support part to be fixed there and to be supported by bearing portion 72 of the unit body U3 in a slide free state. It is installed so that it can freely move on this side of the unit body U3.

The stable knife shaft 70 is designed to have a coil spring 74 fit between a pin 70' provided on its left end and the bearing portion 72. A movable knife 71 is made to have a coil spring 75 fit between a cylindrical cam 73 provided on its left end and a rise-and-fall link 56*d* in a knife driving mechanism 59. The two knife shafts are normally pulled with force to the left during driving and maintain the knife fixing feed bar 55 normally in a prescribed position, with a stopping lever 76 contacting the left end of the stable knife shaft 70 and by a movement operation cam 77 supporting the lever 76.

When performing, for example, darn stitching using the above-mentioned over-lock stitch unit 3, it is done by turning an operation dial 78 exposed on the left side of the unit body U3, and pushing the movable knife 40 together against the coil spring 74, and moving the knife fixing feed bar 55, which forms one body with the fixed knife shaft 70, and the fixed knife 39.

Further, when stitching does not require a knife, the stitching can be carried out by pushing in an operation lever 79 exposed on the left side of the unit body U3, moving the cylindrical cam 73 to the right with a contacting portion 80 provided on the upper part of the lever 79. A rod 81 extends from the movable knife 40 in parallel with the movable knife shaft 71 and contacts a cam slope 82 of the cylindrical cam 73 to guide the rod 81. The movable knife shaft 71 and the movable knife 40 are turned to this side while the rod 81 is pushed to the right, and the movable knife 40 is put out of the way.

The knife fixing feed bar 55 is designed, as shown in FIG. 16, with a pivotal shaft 83 as one body from the right side of its lower edge toward the connecting surface 5 of the machine proper 1. A bearing portion 84 formed on the lower edge of the knife cover 42 is pivotally mounted onto the shaft 83. The cover 42 is combinedly used as a cut waste removing chute, having its upper side laid along the outer side of the stable knife 39. The knife cover 42 is linked with the pivotal shaft 83 so that it can move sideways as one body with the knife fixing feed bar 55 so that the knife cover 42 does not prevent the movement of the movable knife 40 and the stable knife 39.

As shown in FIG. 16, the knife cover 42 is linked with a front cover 41, touching the right side of the cover 42 and being pivotally mounted at its lower edge on the bed 1" by a pivotal shaft 85.

By making a pin 86 provided on the right side of the upper part of the knife cover 42 fit into a circular-arc-shaped guide groove 87 provided on the left side of the front cover 41, with the pivotal shaft 85 as a center of a circle, the knife cover 42 opens and closes as one body following the opening and closing of the front cover with the pivotal shaft 85 as a fulcrum.

Accordingly, when using the machine proper 1 as an over-lock sewing machine, when the front cover 41 is opened for threading the needle, the knife cover 42 opens at the same time with the pivotal shaft 83 as a fulcrum. Thus, the threading work to the upper and lower loopers 47 and 49 provided in the rear of the knife fixing feed bar 55 becomes easy.

Figure 17:
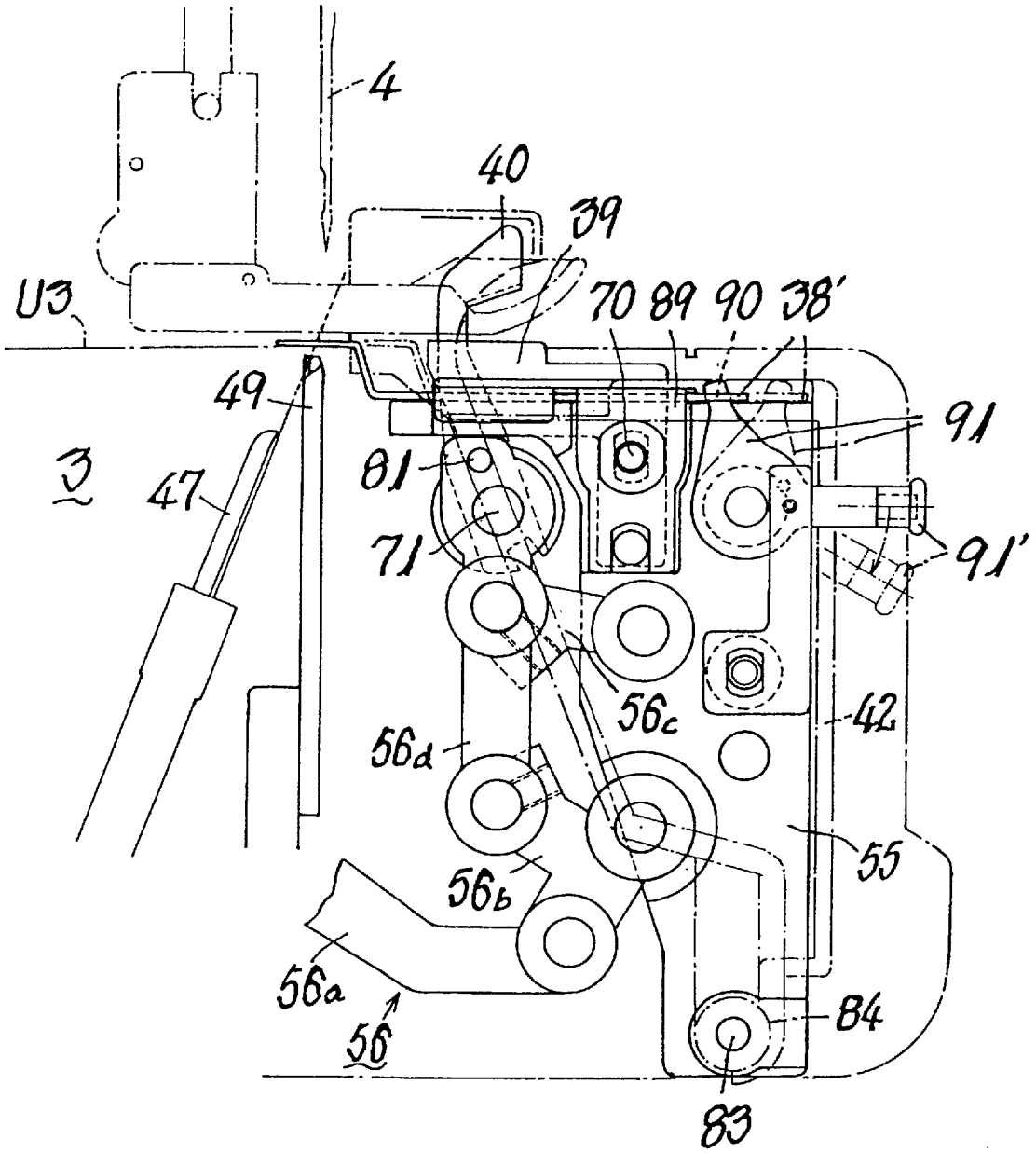
FIG. 17 is a partially cutaway side view of a portion of a knife table and a portion of a stitch width tongue for hem stitch switching.

Further, the knife fixing feed bar 55 is designed, as shown in FIGS. 16 and 17, to provide on its upper surface a supporting surface 88 having an L-shaped section which supports in a longitudinally slide free state, a sliding portion 38' extend as one body on this side of the stitch width tongue 38 for a rolled hem. To the left side of the knife fixing feed bar 55 is fixed a pressing plate 89 to guide the sliding portion 38' of the stitch width tongue 38 from the open side (left-hand side in FIG. 16) and above the supporting surface 88.

As shown in FIG. 17, a fitting hole 90 is provided on the sliding portion 38' of the stitch width tongue 38 protruding to the rear of the pressing plate 89. Into the fitting hole 90 is fitted the top end of a switching lever 91 pivotally mounted on this side of the knife fixing feed bar 55. An operational end 91' of the lever 91 protrudes on the side of the over-lock stitch unit 3 in a switching free state. During a rolled hem operation, the operational end 91' of the switching lever 91 is pushed down so as to separate the stitch width tongue 38 for switching the rolled hem far from the fixed needle plate tongue 37.

Further, it is a matter of course that when the operational end 91' is pushed up, the stitch width tongue 38 returns.

Figure 20:
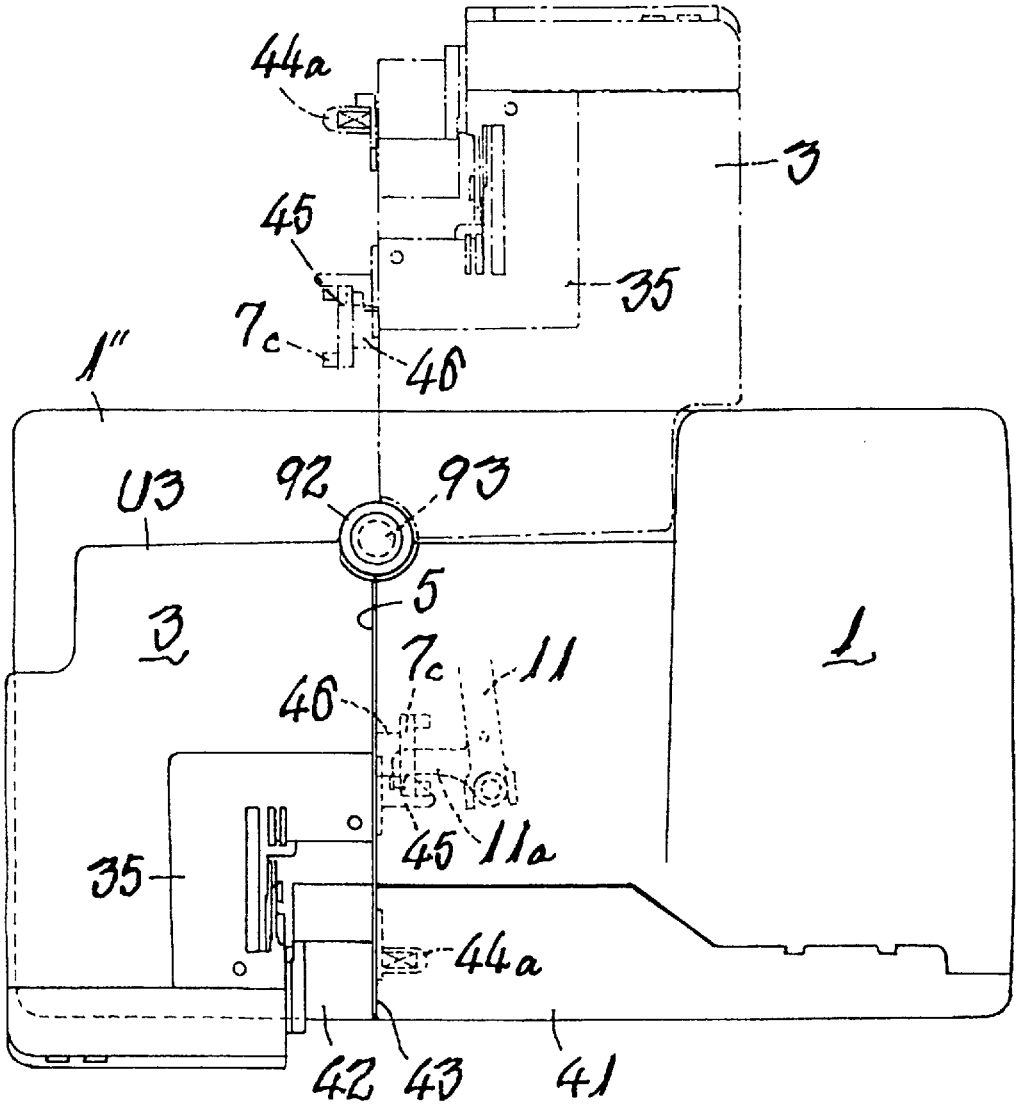
FIG. 20 is a partially cutaway plan view in the case of holding an over-lock stitch unit in a rotation free state.

As the over-lock stitch unit 3 is larger and heavier than the lock stitch unit 2, the mounting and detaching work for exchanging units is not easy. However, as shown in FIG. 20, if a vertical bearing portion 92 is provided at a forward location along the connecting surface 43 of the cover-lock stitch unit 3, and the bearing portion 92 is pivotally mounted on a supporting shaft 93 similarly vertically installed at a forward location of the connecting surface 5 of the machine proper 1 and is moved to the other side of the bed 1" as shown with a chain line in the drawing when not using the over-lock stitch unit 3, the work for exchanging units becomes easy and labor can be saved.

Now, it goes without saying that in the working example 1, all fitting portions 10 to be exposed on the connecting surface 5 of the machine proper 1 and fitting portions 44*a*, 44*c* of the over-lock stitch unit 3 enable fitting and detaching from an obliquely side ward direction along a rotation locus with the supporting shaft 93 as the center of a circle.

As stated above, the machine proper 1 of the working example 1 utilizes a sewing machine which can perform both lock stitching and over-lock stitching. Accordingly, when lock stitching, it is required to carry out a vertical rise-and-fall of the needle 4 and a swinging rise-and-fall of the needle for zigzag stitching. When over-lock stitching, it is required to stop lateral swing of the needle 4 and to let it perform an exact vertical rise-and-fall.

For this reason, the machine proper 1 is provided with a swing fixing means 94 of the needle bar.

Figure 18:
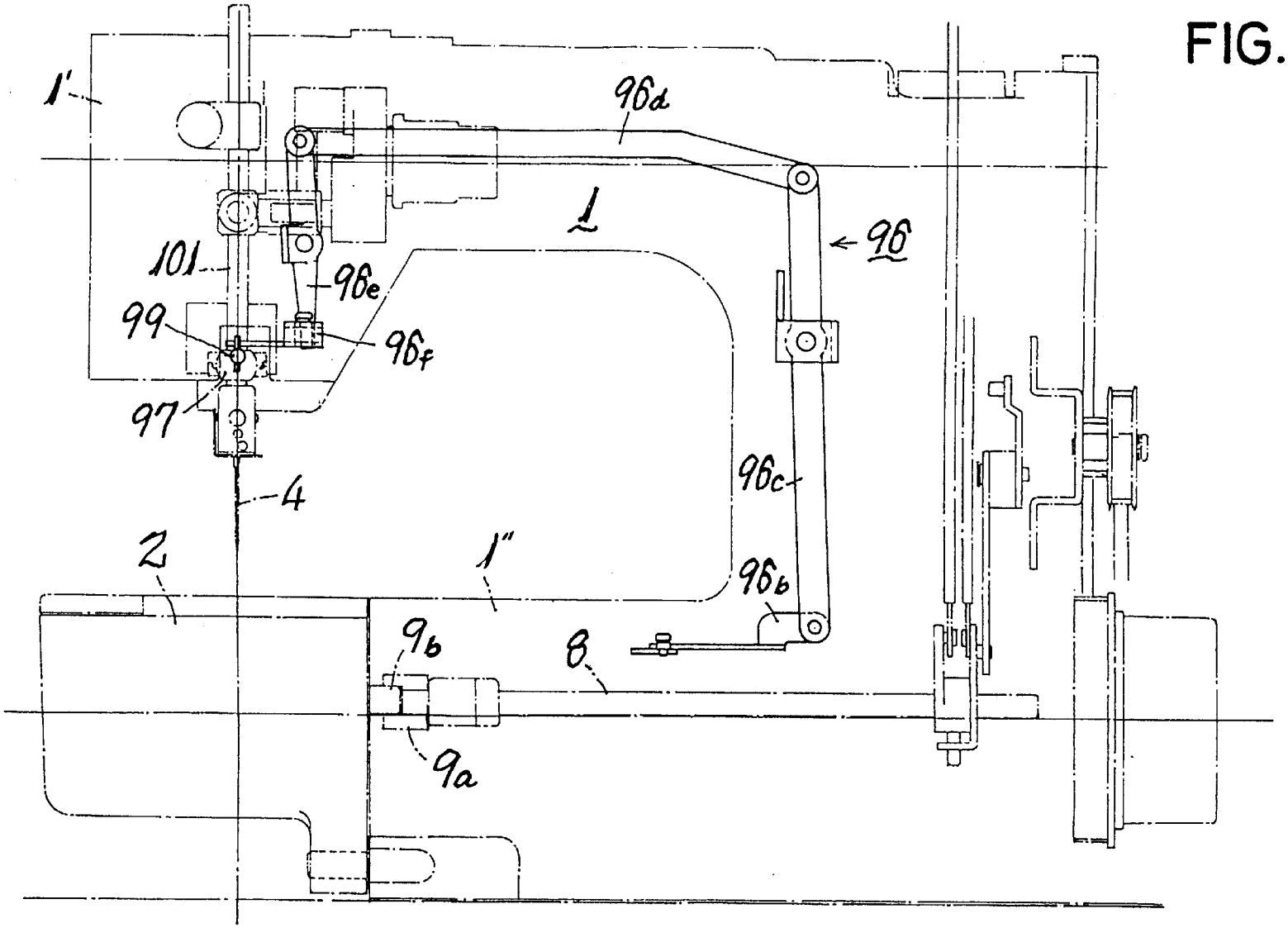
FIG. 18 is a partially cutaway front view of a swing fixing means of a needle bar.
Figure 19:
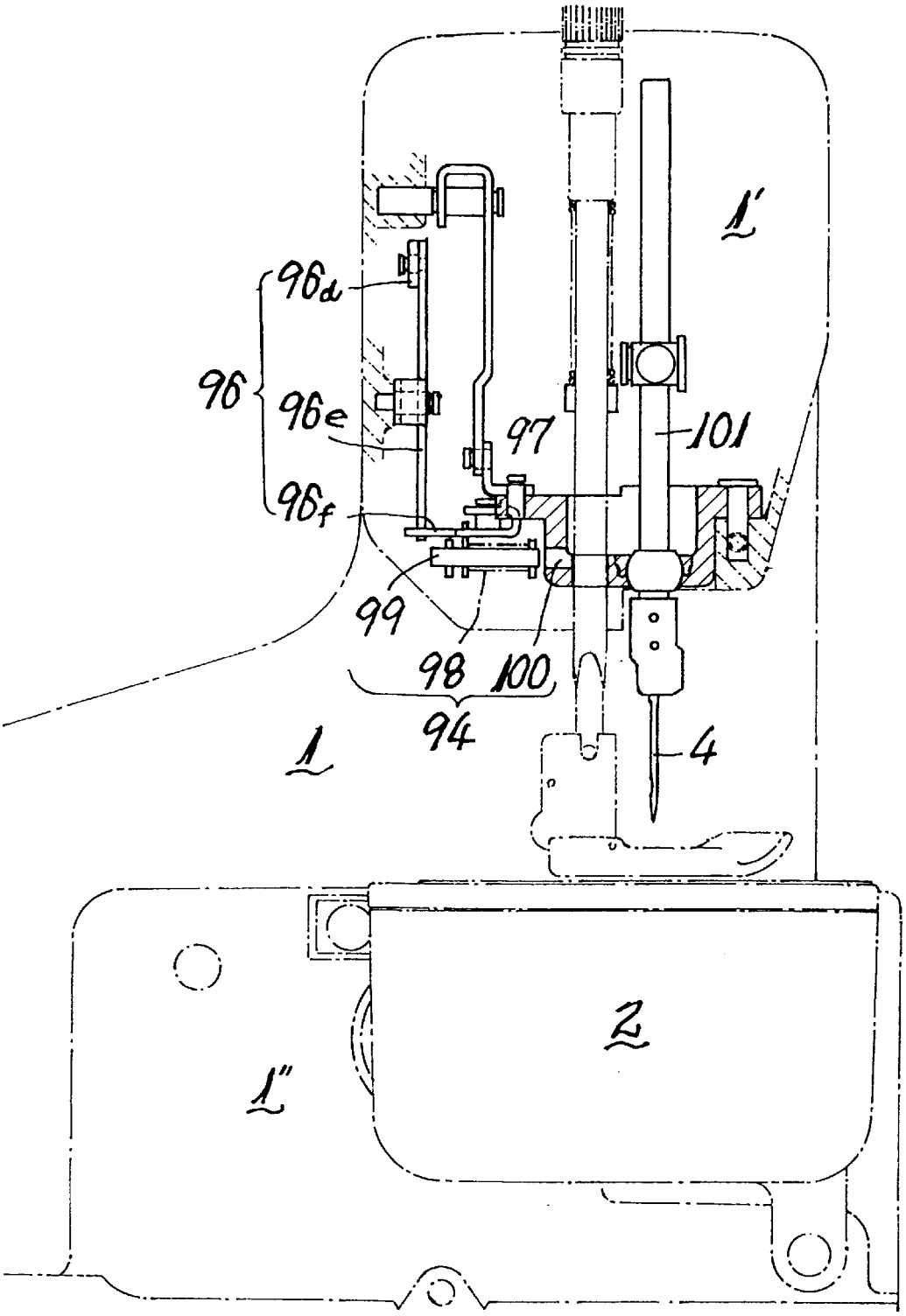
FIG. 19 is a partially cutaway side view of a swing fixing means of a needle bar.

The swing fixing means 94 of the needle bar, as shown in FIGS. 7 and 10, is constituted by:

- a contacting element 95 of a slide-rod shape installed so that it exposes its left end inside of a fitting portion 10*e* specially provided in the machine proper 1: a fitting portion 44*c* of the sewing unit fits in portion 10*c* and contacts element 8 only when the over-lock stitch unit is connected, and the element 95 moves backward when the fitting portion 44*c* is fitted;
- a plural number of links 96 comprising a link 96*a* to convert a backward movement of the connecting element 95 to a swing movement, a link 96*b* to convert the swing of the link 96*a* to a slide movement, and as shown in FIG. 18, a link 96*c* to convert the slide of the link 96*b* to a vertical swing, a link 96*d* horizontally installed with its one end connected to the link 96*c* and its other end connected to a link 96*e* vertically installed near a needle bar 101, and a link 96*f* of a bell-crank shape; and
- a control rod 99, as shown in FIG. 19, installed near a needle bar support 97 to give an amplitude to the needle 4, and provided with a coil spring 98 which is normally pulled is in force in a direction of separation from the needle bar support 97, and linked with the top end of the bell-crank-shaped link 96*f*.

When the fitting portion 44*c* of the over-lock stitch unit 3 is inserted into the fitting portion 10*c*, the backward movement of the contacting element 95 is transmitted to the control rod 99 through those links 96 and the control rod 99 resists the spring 98 and fits into a fitting hole 100 provided at a prescribed place on the needle bar support 97. Accordingly, when the over-lock stitch unit 3 is connected, the needle bar 101 is automatically fixed to prevent a lateral swing of the needle bar.

Now, the present invention is not always applied to the case of using a sewing machine capable of both lock stitching and over-lock stitching as the machine proper 1, but also to other cases, for example, connection of a lock stitch unit to a machine proper having the single function of lock stitching or connection of an over-lock stitch unit to a machine proper having the single function of over-lock stitching, thus using those machines respectively as a sewing machine of a single function. There are also such cases as connection of a sewing unit having some other stitching function to a machine proper so as to use the machine as a different sewing machine of a single function.

In any case, it is possible to carry out the assembling of a machine proper and the assembling of a sewing unit simultaneously. Therefore, there are advantages such that a production line is not unified and productivity is improved by adopting, for example, a TACT method, and assembling is lightened.

Further, as a change of design of the present invention, it is optional to prepare plural sewing units having different functions from lock stitching and over-lock stitching and connect them respectively to a single machine proper in such a way that they can be freely mounted, detached, and exchanged for carrying out a desired mode of stitching.

In the following, the present invention will be described in a working example 2.

The working example 2 is for a case of applying the present invention to flat stitching as shown in FIGS. 21–30.

Figure 25:
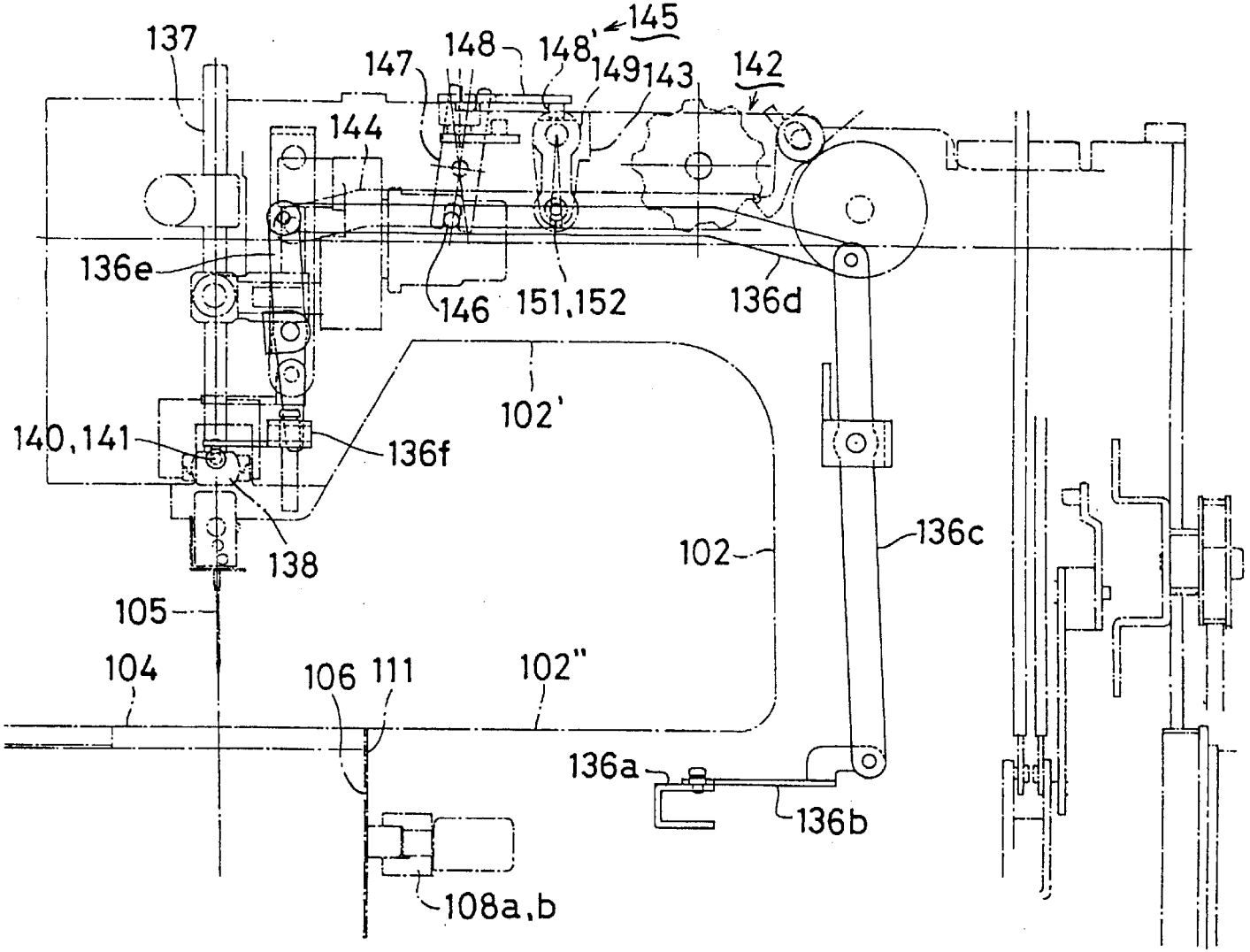
FIG. 25 is a partially cutaway front view briefly showing the upper part of the machine proper.

A machine proper 102 is formed, as shown in FIG. 25, by cutting off the left-end portion of a bed 102" vertically at a place appropriately spaced to the right of a raise-and-fall position of a needle 105 and leaving the cut-off portion with a connecting surface 106. On the other hand, a covering hem unit 104, formed separately from the machine proper 102, is provided with a fitting structure to fix a linking position with the machine proper 102 and a combining means to tighten the state of fitting.

Figure 21:
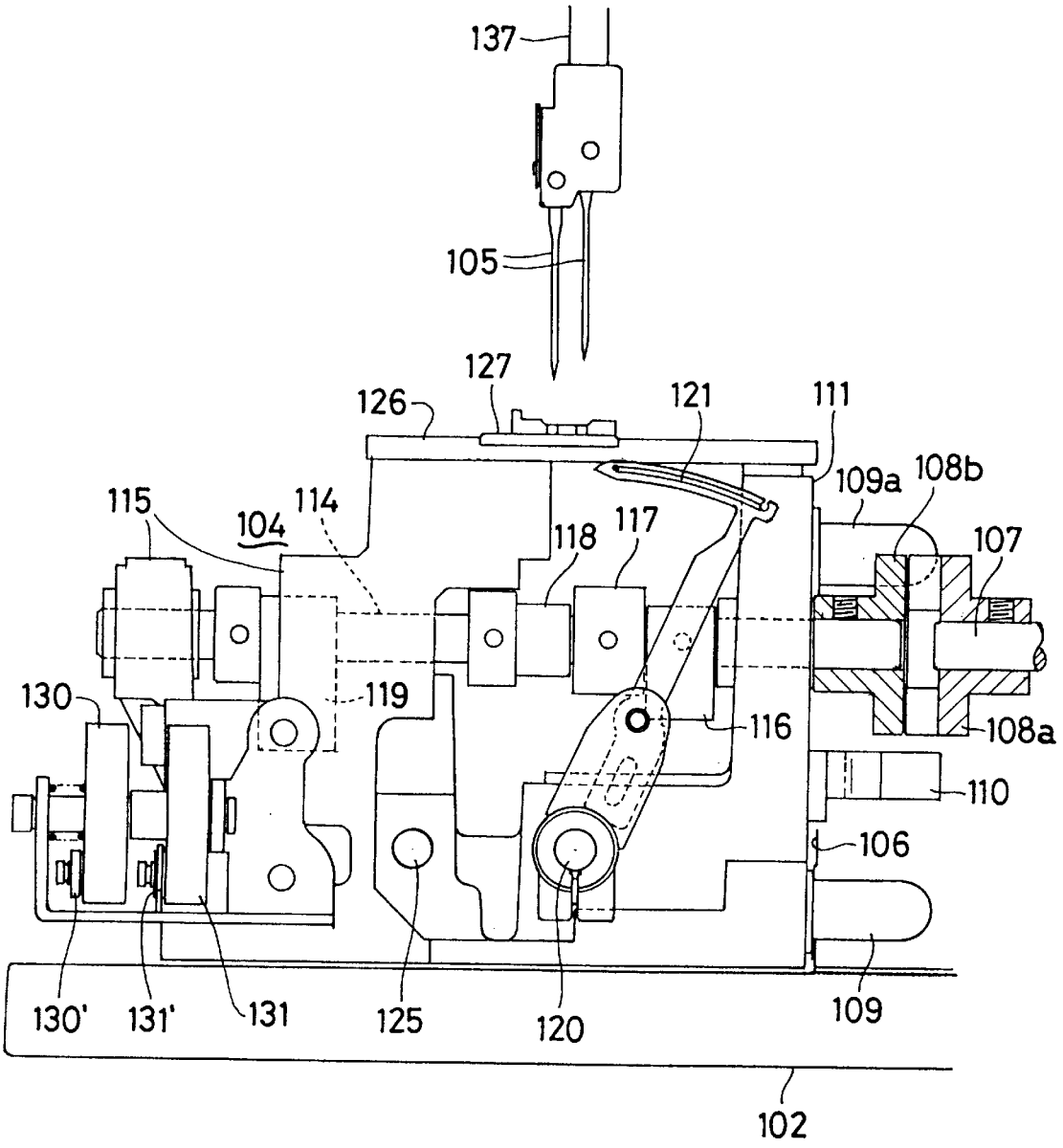
FIG. 21 shows working example 2 and is a partially cutaway front view of a portion of a covering hem unit.
Figure 22:
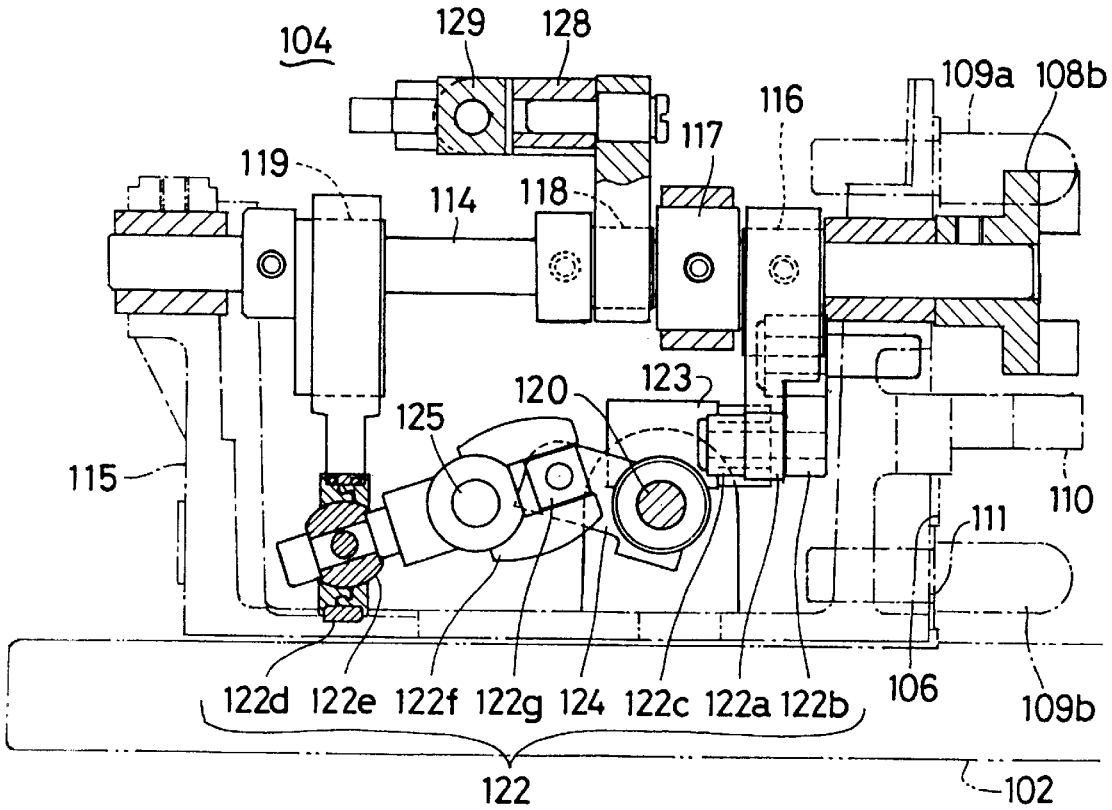
FIG. 22 is a partially cutaway front view of a portion of a driving mechanism of a portion of a covering hem unit.
Figure 23:
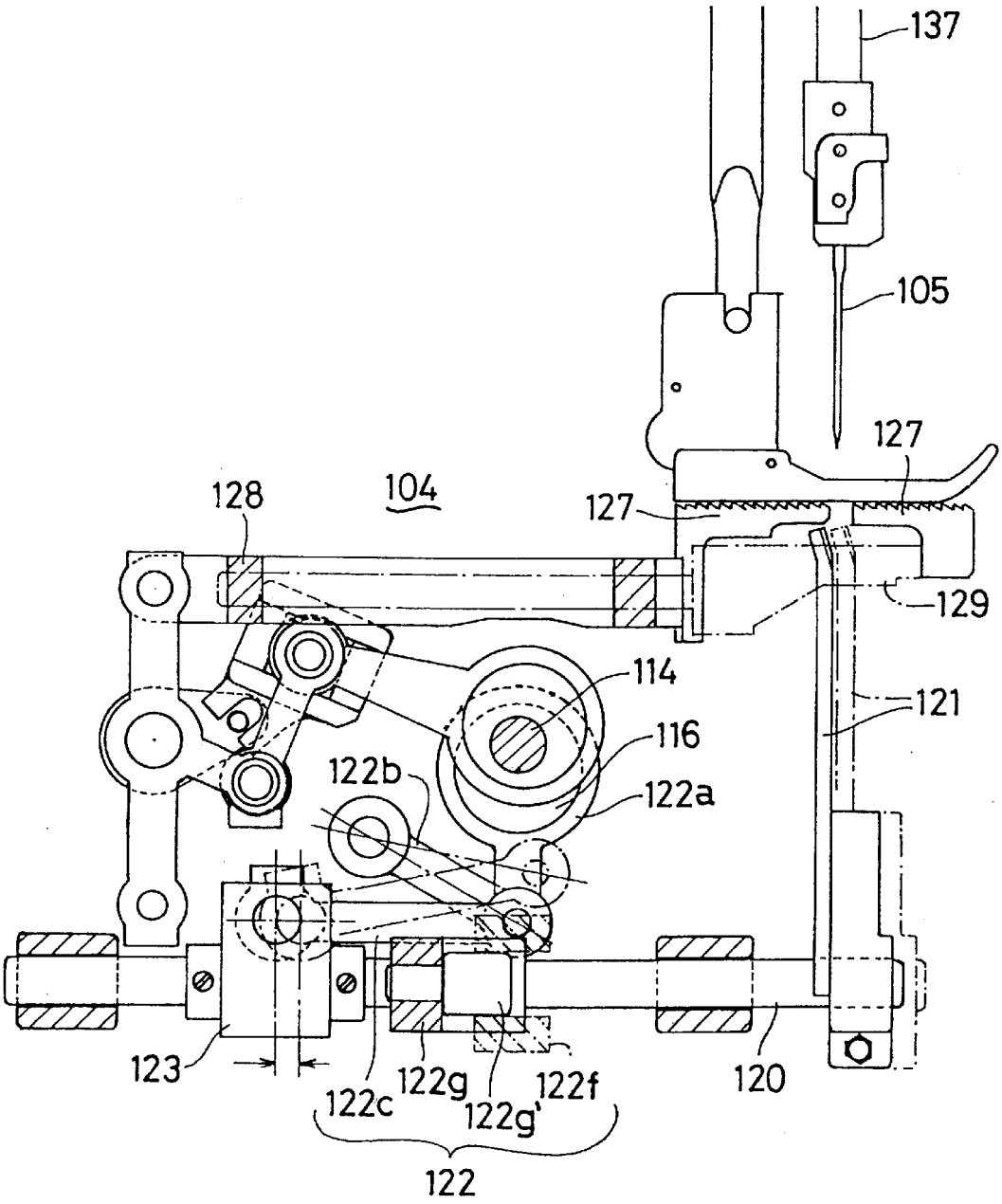
FIG. 23 is a partially cutaway left-hand side view of a portion of a covering hem unit.
Figure 24:
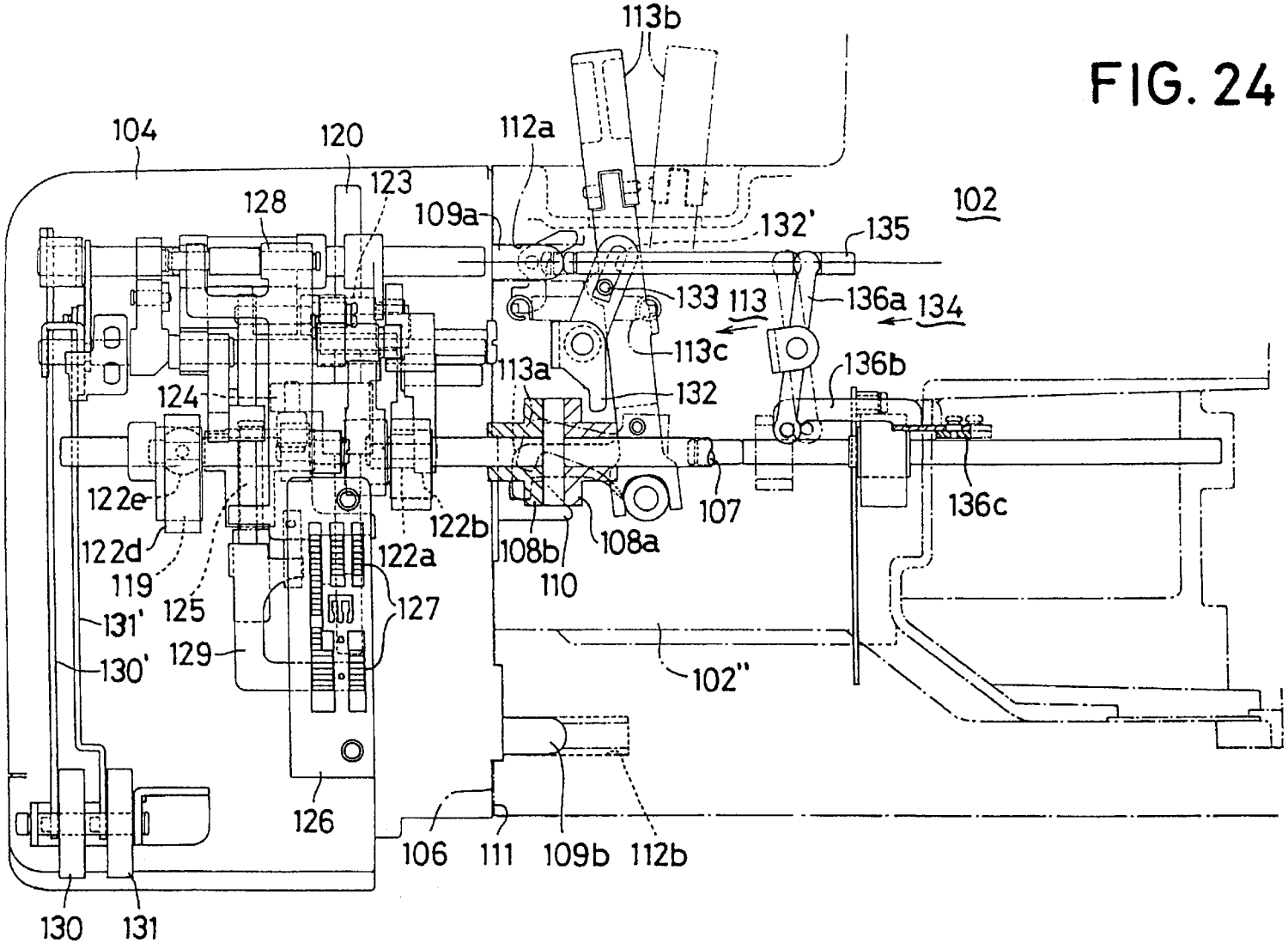
FIG. 24 is a partially cutaway plane view showing a portion of a connection to the machine proper.

The covering hem unit 104, as shown in FIGS. 21, 22 and 24, has a right side formed as a connecting surface 111 having a shaft coupling 108*b* to be linked with a lower shaft 107 of the machine proper 102. Two fitting portions 109*a* and 109*b* have hemispherical ends, and a combining portion 110 has the shape of a backward motion stopping hook.

By connecting the above to a shaft coupling 108*a* exposed on the connecting surface 106 of the machine proper 102, two fitting holes 112*a* and 112*b* and a combining portion 113*a* of a combining means 113, respectively, the covering hem unit 104 is combined with the machine proper 102 as one body.

In the covering hem unit 104, as shown similarly in FIGS. 21, 22, 24, a rotary shaft 114 is disposed coaxially with the lower shaft 107 for rotation together through shaft couplings 108*a*, 108*b* and is supported on both sides of a frame 115 in a free rotation state. It also has a looper slide cam 116, a looper swing cam 117, a horizontal cloth feed cam 118, and a vertical cloth feed cam 119 fixed on it in the order as shown from the right in FIG. 21.

Further, as shown in FIGS. 21 and 22, the covering hem unit 104 allows a forward and backward sliding of the machine at a prescribed distance along a cloth feed direction crossing at right angles with the rotary shaft 114 directly below the rise-and-fall position of a needle 105. A looper shaft 120 is laterally disposed, which can rotate left and right at a prescribed angle and has a looper 121 for cover hemming fixed on the front end of the looper shaft 120.

A driving mechanism 122 of the looper 121, as shown in FIGS. 21 and 22, is composed of:

a cam link 122*a* linking a sliding block 123 fixed on the looper shaft 121 with the looper slide cam 116; a first swing arm 122*b;* a second swing arm 122*c;* a cam link 122*d* linking a swing lever 124, fixed similarly on the looper shaft 120, with the looper swing cam 117; a spherical coupling 122*e;* and a forked swing lever 122*f* extending from a middle shaft 125 connecting the bottom end of the spherical coupling 122*e* and the swing lever 124, to swing the looper shaft 120, via a square piece 122*g* fitted into the forked swing lever 122*f*.

The looper driving mechanism 122 having the above-mentioned structure, like a conventional flat sewing machine, lets the looper 120 slide forward and backward while swinging to the right and left in concert with the rotation of the lower shaft 6. It also lets the top of the looper 121 travel a prescribed elliptical orbit repeatedly in accordance with the rise-and-fall of the needle 105.

Further, the flat stitch unit 104 is provided with a needle plate 126, feeding teeth 127, a main feeding bar 128 and an auxiliary feeding bar 129. It drives the main feeding bar 128 and the auxiliary feeding bar 129 reciprocally following a rotation of the horizontal cloth feed cam 118 and the vertical cloth feed cam 119 moving in concert with the rotation of the lower shaft 107.

By the way, the mark 130 in the drawing indicates a main cloth feed control dial and 131 indicates a differential cloth feed control dial. The two elements enable the control of the distance of reciprocation of the main feeding bar 128 and that of the auxiliary feeding bar 129 through control rods 130' and 131' linked with them, respectively, and through a control mechanism (omitted in the Drawing).

As shown in FIG. 24, the covering hem unit 104 makes the afore stated two fitting portions 10*a*, 109*b* fit into the fitting holes 112*a*, 112*b* provided on the connecting surface 106 of the machine proper 102 and connects the shaft coupling 108*b* of the sewing unit to the shaft coupling 108*a* of the machine proper 102 and further makes the combining portion 113*a* of the machine proper 102 engage with the combining portion 110 of a backward motion stopping hook shape. By returning a handle lever 113*b* of the combining means 113 from a position of a dotted line in FIG. 24 to the left, the two connecting surfaces 106 and 111 come to agree with each other, and thus the sewing unit is connected to the machine proper as one body.

The handle lever 113*b* of the combining means 113 to press the covering hem unit 104 to the machine proper 102 is pulled by a traction spring 113*c* provided between the lever 113*b* and the machine proper 102. The fitting of the combining portion 110 of a backward motion stopping hook shape to the combining portion 113 is done by resisting the pulling force of the traction spring 113*c*.

When the handle lever 113*b* has its position changed to a position shown with a chain line in FIG. 24, resisting the pulling force of the traction spring 113*c*, the combining portion 113*a*, swinging together with the lever 113*b*, gets out of the combining portion 110. It thereby becomes possible to remove the flat stitch unit 104, released from the pressed state, from the machine proper 102.

Figure 30:
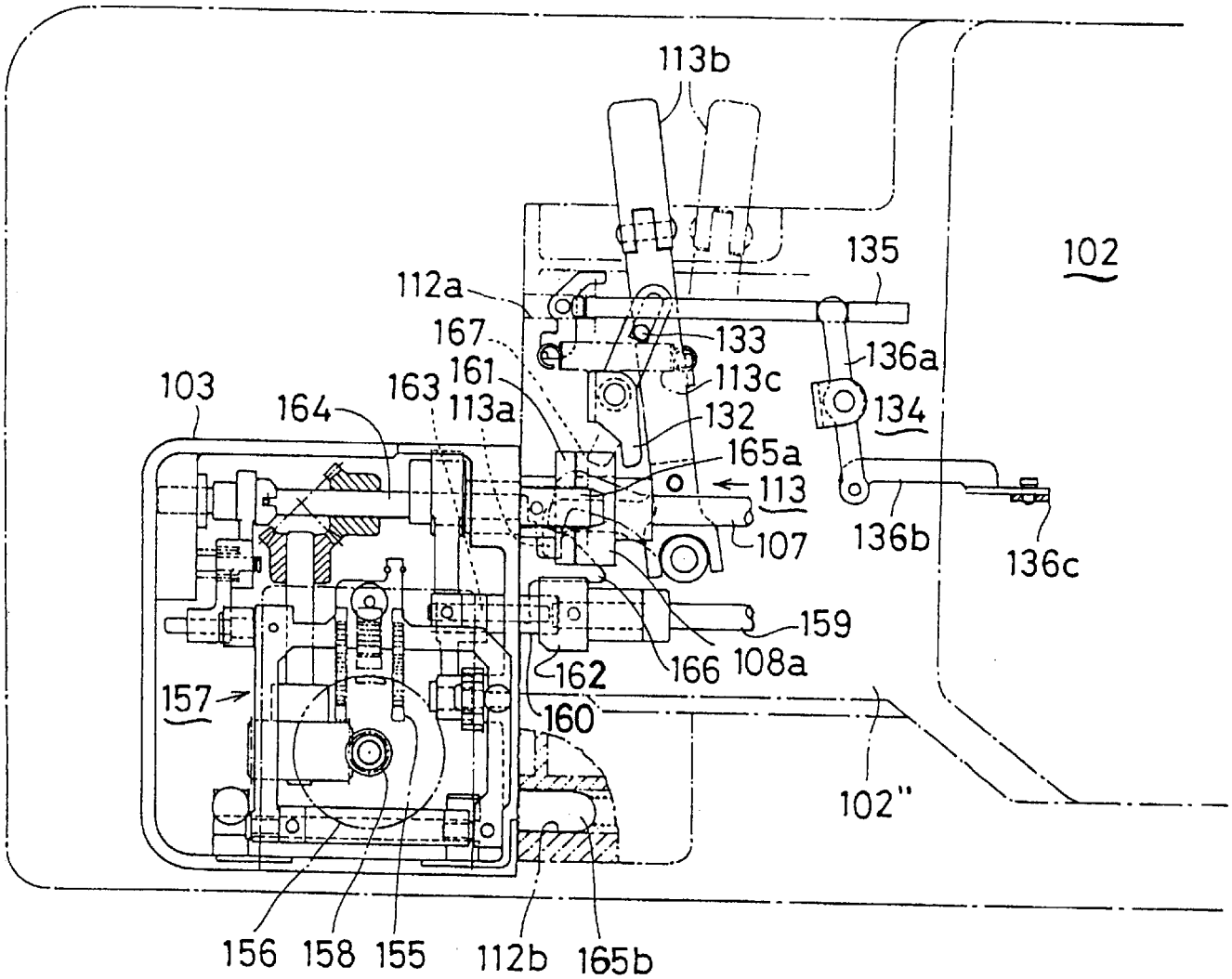
FIG. 30 is a partially cutaway plane view briefly showing the case of connecting lock stitch unit.

A top portion fixing lever 132 has a long hole 132' put into with a pin 133 loosely disposed therein such that it protrudes in the middle of the handle lever 113*b*. The lever 132 fits into a slit 167 formed on the side of the shaft coupling 108*a* of the machine proper 102 (as shown in FIG. 30, to be introduced later), and maintains a rotation stopping position of the lower shaft 107 in accordance with the needle position. Thus, the flat stitch unit 104 is designed to be mounted and detached only when the needle 105 is at a risen position.

In working example 2, the machine proper is designed to be able to have the lock stitch unit 103 mounted to it in exchange for the covering hem unit 104 as described above. But, in the case of using a covering hem unit, it is necessary to exactly check the lateral swing of the needle 105 in order to let the needle perform the rise-and-fall movement only.

For this reason, the machine proper 102 is provided, as shown in FIG. 24 and the following drawings, with a swing fixing means 134 for the needle bar extending from the mounting/detaching position of the covering hem unit 104 extending over the needle bar supporting position.

Figure 26:
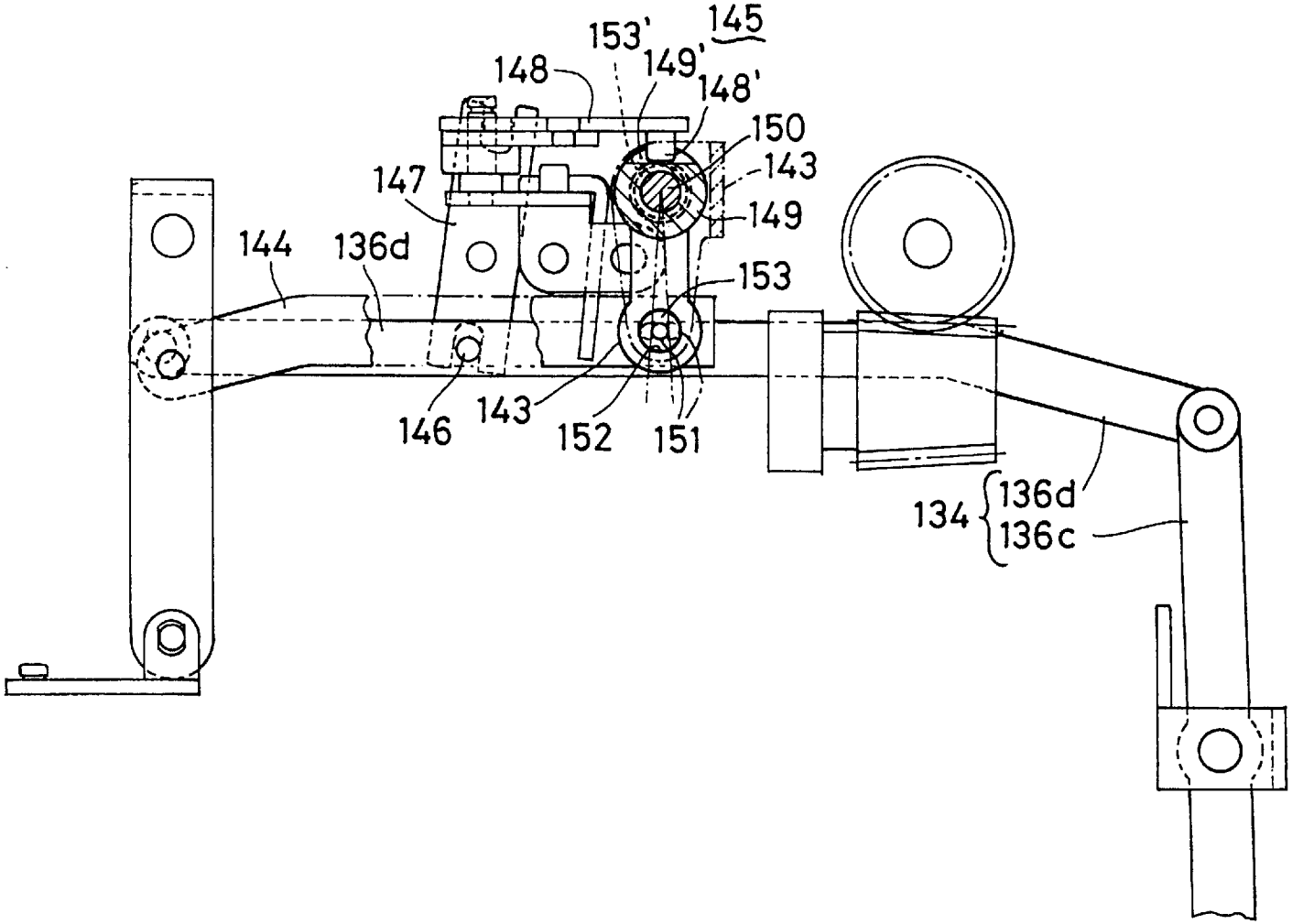
FIG. 26 is a partially cutaway front view of a portion of a zigzag actuation clutch.
Figure 27:
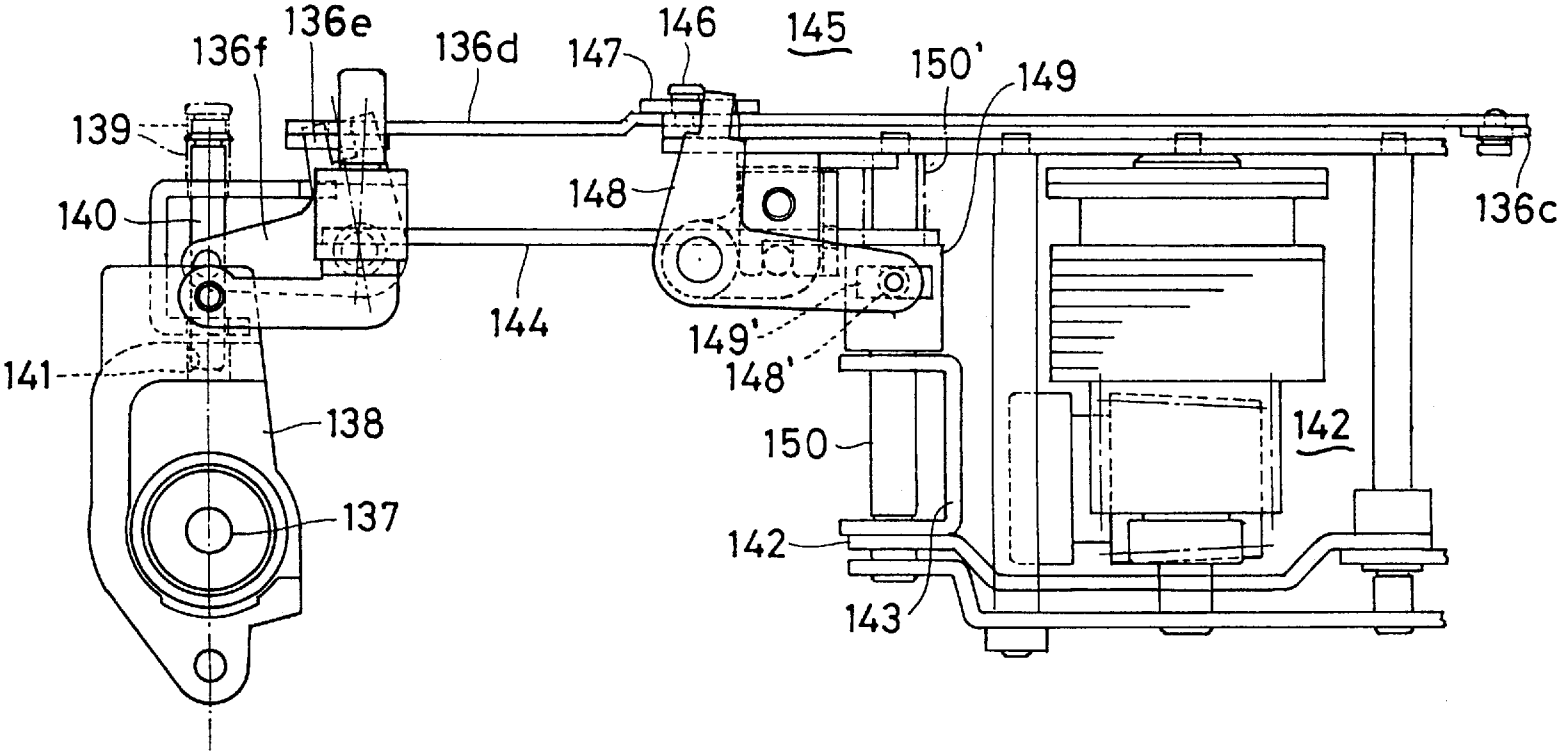
FIG. 27 is a partially cutaway plan view showing the inside structure of the upper part of the machine proper.

The swing fixing means 134 of the needle bar is constituted by:

a contacting element 135 of a slide rod shape designed to expose its left end at the inner end of a fitting hole 112*a* of the machine proper 1 or to which the fitting portion 109*a,* one of the two fitting portions of the covering hem unit 104 disposed at a forward position in a cloth feed direction, is fitted in and also designed to move backward when the fitting portion 109*a* is fitted in;

plural links 136 comprising a link 136*a* linked with right end of the contacting element 135 to convert its backward movement to a swing, a link 136*b* to convert the swing of the link 136*a* to a slide, a link 136*c* to convert the slide of the link 136*b* to a vertical swing as shown in FIGS. 25, 26, a lateral link 136*d* disposed laterally in an arm of the sewing machine and connecting its one end with the upper end of the link 136*c* and its other end with the upper end of a vertical link 136*e* provided near a needle bar 137, and which converts the slide of the above-mentioned contacting element 135 to a reversely lateral slide, and a link 136*f* of a bell crank shaped to convert the slide of the vertical link 136*e* to a lateral swing at a position near a needle bar support 138; and a control rod 140 provided near the needle bar support 138 giving an amplitude to the needle 105 as shown in FIG. 27, and normally pulled with force by a coil spring 139 in a direction of separation from the needle bar support 138, and linked with the top of the above-mentioned link 136*f.*

When the fitting portion 109 of the covering hem unit 104 is fitted into the above-mentioned fitting hole 112*a,* the backward movement of the contacting element 135 is transmitted to the control rod 140 through the links 136 and the control rod 140 fits into the hole 141 provided at a prescribed position of the needle bar support 138, resisting the coil spring 139. Thereby, when mounting the covering hem unit 104, the swing of the needle bar 137 is automatically controlled, and lateral swing of the needle 105 is prevented.

It is needless to say that when the fitting portion of the flat stitch unit 104 comes out of the fitting holes 112*a,* the fixing of the needle bar 137 is automatically released.

Separately from the swing fixing means 134 of the needle bar working in the above-mentioned way, the machine proper 102 is designed to provide a zigzag actuation clutch 145. The clutch 145 links with the actuation of the swing fixing means 134 of the needle bar 137 between a zigzag lever 143, which swings, being driven by a zigzag actuation means 142, and a zigzag guide plate 144, which transmits a swing of the zigzag lever 143 to the needle bar support 138. The machine proper 102 is also designed to cut off transmission between the zigzag lever 143 and the zigzag guide plate 144 automatically.

Figure 28:
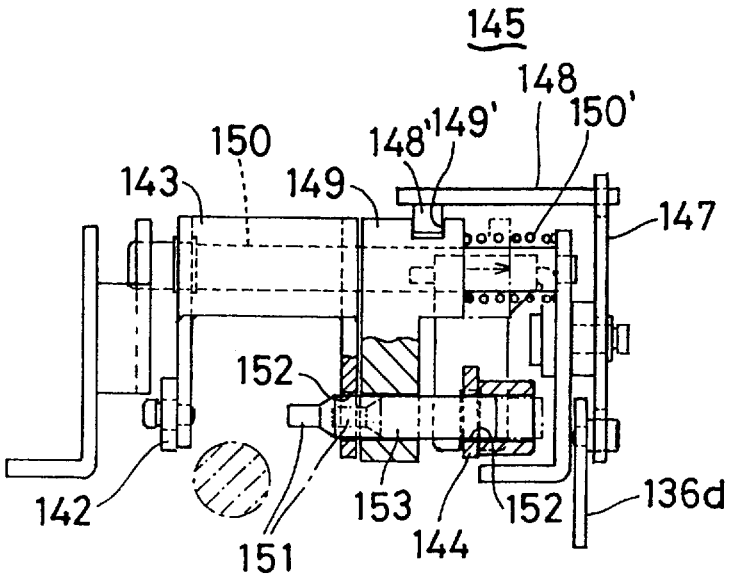
FIG. 28 is a partially cutaway left-hand side view of a portion of a zigzag actuation clutch.

The zigzag actuation clutch 145, as shown in FIG. 25, is composed of:

a pin 146 provided in such a way as to protrude from the middle of the lateral link 136*d* of the above-mentioned swing fixing means 134 and disposed laterally in the arm of the machine;

a forked lever 147 having both its edges formed into a fork shape and having the pin 146 fit in between the lower forked portion so as to swing together with reciprocation of the lateral link 136*d;* a bell crank 148 fitting one end in to the upper part of the forked lever 147 as shown in FIGS. 26 and 27;

a shifter 149 which has a pin 148' provided on the other end of the bell crank 148 to fit in a lateral groove 149' formed on its upper surface and which fits in a fulcrum shaft 150 of the lever 143 so as to swing on a shaft common to the zigzag lever 143; and a linking pin 153 as shown in FIG. 28, which has a shaft 151 of a small diameter on its one end, and which passes through the lower part of the shifter 149 in parallel with the fulcrum shaft 150 so as to be fixed to the shifter 149 as one body and which inserts both ends into through holes 152 provided in common at the lower end of the zigzag lever 143 and in the middle of the guide plate 144. In the case of an inserting position as shown in FIG. 28, the swing of the zigzag lever 143 is transmitted in to the reciprocation of the zigzag guide plate 144.

The zigzag actuation clutch 145 of the above-mentioned structure works when the lateral link 136*d* of the swing fixing means 134 moves to a swing fixing position and makes the forked lever 147 and the bell crank 148 swing to a position shown with solid lines in FIGS. 26, 27. It makes the shifter 149 move to a position shown with a dotted line in FIG. 28 through the pin 148' of the bell crank 148 and the lateral groove 149'.

In accordance with a switch-over of the shifter 149 to a clutch actuation position, the link pin 153, fixed as one body with the shifter 149, moves backward, and the shaft 151 of a small diameter provided on its one end moves into the passing-through hole 152 of the zigzag lever 143.

The diameter of the shaft 151 is smaller than the inside diameter of the passing-through hole 152 of the zigzag lever 143, and accordingly, even if the larger diameter passing-through hole 152 of the zigzag lever 143 reciprocates the insertion position by a swing of the zigzag lever, such action is not transmitted to the zigzag guide plate 144.

By the way, a mark 150' in the drawing indicates a retraction spring of the link pin 143 and the shifter 149.

It is needless to say that when zigzag stitching, the shifter 149 as well as the zigzag lever 143 and the zigzag guide plate 144 swings on the fulcrum shaft 150, but that such swinging is not transmitted to the bell crank which makes the pin 148' fit into the lateral groove 149'.

Figure 29:
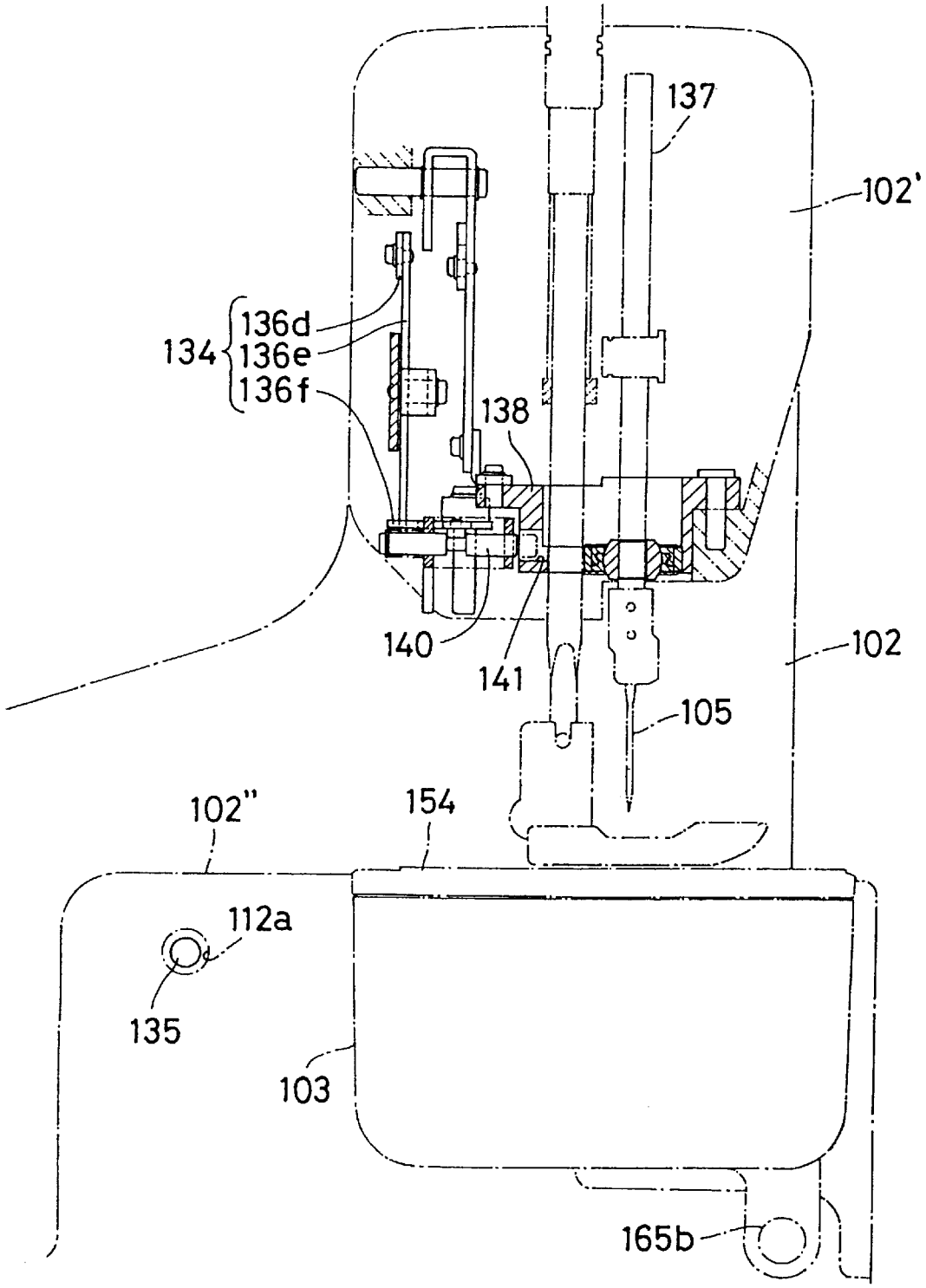
FIG. 29 is a partially cutaway left-hand side view briefly showing the case of connecting a lock stitch unit.

The lock stitch unit 103 to be mounted to the machine proper 102 in exchange for the covering hem unit 104 is shown in FIGS. 29 and 30 in a mounted state.

The lock stitch unit 103, similarly to the above-mentioned covering hem unit 104, has in one unit body, at prescribed places, a needle plate 154, a feeding teeth 155, a shuttle 156, a cloth feed mechanism 157, a shuttle driving mechanism 158, a shaft coupling 160 coupling with a cloth feed control shaft 159, and a shaft coupling 161 coupling with a lower shaft 107. The two shaft couplings 160 and 161 are connected to a shaft coupling 162 of the cloth feed control shaft 159 and to the shaft coupling 108*a* of the lower shaft 107, respectively, so as to rotate following the respective shafts. Two rotary shafts 163 and 164 drive the cloth feed mechanism 157 and the shuttle driving mechanism 158, respectively, and are provided with a combining portion 166 of a backward motion stopping type used to combine two fitting portions 165*a* and 165*b,* and connected with the combining portion 113*a* of the combining means 113.

Fitting portion 165*a* of the lock stitch unit 103 is disposed at a different place from fitting portion 109*a* of the covering hem unit 104. On the connecting surface 106 of the machine proper 102 an open fitting hole 112*a,* into which the fitting portion 109*a* is fitted.

Accordingly, at the time of mounting the lock stitch unit 103, the above-mentioned contacting element 135 of a slide-rod shape comprising the swing fixing means 134 of the needle bar remains not actuated.

By mounting the lock stitch unit 103 of the above-mentioned structure onto the machine proper 102 in the same way as in the case of the covering hem unit 104, it can be used for straight stitching and a zigzag stitching.

Further, in the working example 2, similarly to the working example 1, it is possible to use a machine proper not only a lock stitch machine but also a serger including an overlock machine to connect thereto various kinds of sewing units exchange for each other.

The sewing machine of the present invention, designed to produce a machine proper and a sewing unit separately and then assemble them together, makes production and assembling easier as compared with conventional sewing machines that provide many necessary parts in one machine body.

The sewing machine of the present invention, designed to use plural sewing units of different functions that are exchanged for each other in one machine proper, can reduce the cost of manufacture as compared with the case of producing sewing machines separately with a single function, and gives users the benefit of performing various modes of stitching selectively with one sewing machine. Further, it is simple to exchange sewing units for each other, and there is no need of installing many different sewing machines.

The sewing machine of the present invention, designed to produce plural sewing units separately by their sewing function, differs from the conventional sewing machines providing many different sewing mechanisms in one machine body, in respect of simplicity in the inside structure of each unit, ease in production, accuracy of products, and reduction of breakage or misactuation.

I claim:

1. A sewing machine, comprising:

a sewing machine portion that includes:

a zigzag stitching mechanism, a needle mounted to be capable of rising and falling from a needle position, a machine base having a side connecting surface spaced from the needle position, a lower shaft having a lower shaft coupling at said connecting surface, a cloth feed control shaft parallel with said lower shaft and having a cloth feed control shaft coupling at said connecting surface, a sewing machine portion fitting portion at said connecting surface, and a sewing machine portion connector for connecting said sewing machine base to a sewing unit;

a lock stitch unit comprising:

one unit body having a needle plate, feeding teeth, a shuttle, a cloth feeding mechanism connected with said feeding teeth, a shuttle driving mechanism connected with said shuttle, a rotary shaft connected with said cloth feeding mechanism and having a rotary shaft coupling for connection with said lower shaft coupling, a further shaft coupling connected with said cloth feeding mechanism and for connection with said cloth feed control shaft coupling of said sewing machine, a lock stitch unit fitting portion adapted to engage with said sewing machine portion fitting portion, a lock stitch unit connector adapted to be connected with said sewing machine portion connector for connecting said sewing machine base to said lock stitch unit, and a lock stitch unit connecting surface for engagement with said connecting surface of said machine base of said sewing machine portion, said lock stitch unit connecting surface having said rotary shaft coupling, said further shaft coupling, said lock stitch unit fitting portion, and said lock stitch unit connector provided thereat, whereby said lock stitch unit can be detachably mounted to said sewing machine portion;

an over-lock stitch unit comprising:

one unit body having a needle plate, feeding teeth, a looper mechanism, a looper driving mechanism, a cloth feeding mechanism connected with said feeding teeth, a rotary shaft connected with said cloth feeding mechanism and having a rotary shaft coupling for connection with said lower shaft coupling, an over-lock stitch unit fitting portion adapted to engage with said sewing machine portion fitting portion, an over-lock stitch unit connector adapted to be connected with said sewing machine portion connector for connecting said sewing machine base to said over-lock stitch unit, and an over-lock stitch unit connecting surface for engagement with said connecting surface of said machine base of said sewing machine portion, said lock stitch unit connecting surface having said rotary shaft coupling, said over-lock stitch unit fitting portion, and said over-lock stitch unit connector provided thereat, whereby said over-lock stitch unit can be detachably mounted to said sewing machine portion; and a covering hem unit comprising:

one unit body having a needle plate, feeding teeth, a covering hem looper, a covering hem looper driving mechanism, a cloth feeding mechanism connected with said feeding teeth, a rotary shaft connected with at least one of said cloth feeding mechanism and said covering hem looper driving mechanism and having a rotary shaft coupling for connection with said lower shaft coupling, a covering hem unit fitting portion adapted to engage with said sewing machine portion fitting portion, a covering hem unit connector adapted to be connected with said sewing machine portion connector for connecting said sewing machine base to said covering hem unit, and a covering hem unit connecting surface for engagement with said connecting surface of said machine base of said sewing machine portion, said covering hem unit connecting surface having said rotary shaft coupling, said covering hem unit fitting portion, and said covering hem unit connector provided thereat, whereby said covering hem unit can be detachably mounted to said sewing machine portion.

2. The machine of claim 1, wherein at least two of said units are detachably mounted on said sewing machine portion so as to be exchangeable for each other.

3. The machine of claim 1, wherein:

said sewing machine portion fitting portion comprises a movably mounted contact element engageable by one of said over-lock stitch unit fitting portion and said covering hem unit fitting portion when said over-lock stitch unit and said covering hem unit are connected with said sewing machine portion;

said needle has a needle bar support;

a control rod extends adjacent to said needle bar support, said control being movably mounted from a position out of engagement with said needle bar support to a position in engagement with said needle bar support a plurality of links connect said contact element with said control rod, and said contact element is biased by a spring such that when one of said over-lock stitch unit fitting portion and said covering hem unit fitting portion engage with said sewing machine portion fitting portion, said contact element moves against the force of said spring and moves said control rod to said position in engagement with said needle bar support.

4. The machine of claim 1, wherein said needle of said sewing machine portion is arranged so as to move vertically in concert with a lock stitch and a zigzag stitch, and wherein said looper mechanism of said over-lock stitch unit comprises an upper looper having a fixing shaft that is inclined about 20 degrees with respect to a plane perpendicular to the vertical movement of said needle.

5. The machine of claim 1, wherein said over-lock stitch unit further comprises:

a knife fixing feed bar mounted for lateral movement and having a knife mounted thereon;

a pivotal shaft mounted in said over-lock stitch unit extending from said knife fixing feed bar toward said over-lock stitch unit connecting surface; and a knife cover having a lower edge that is pivotally mounted onto said pivotal shaft, said knife cover defining a cut waste removal chute, whereby said knife cover is linked for lateral movement together with said knife fixing feed bar.

6. The machine of claim 5, wherein:

a front cover is pivotally mounted at a lower edge thereof onto said machine base, said front cover having a guide groove formed in one side thereof; and said knife cover is disposed adjacent to said front cover at one side thereof, said knife cover having a fitting pin disposed in said guide groove, whereby said knife cover opens and closes, pivoting about said pivotal shaft, together with opening and closing movement of said front cover.

7. The machine of claim 1, wherein said over-lock stitch unit further comprises:

a stitch width tongue for rolled hem switching;

a knife fixing feed bar having an upper supporting surface of an L-shaped section that supports a sliding portion of said stitch width tongue for rolled hem switching;

a pressing plate fixed on a side of said knife fixing feed bar for guiding said sliding portion of said stitch width tongue;

a fitting hole on said sliding portion of said stitch width tongue at a portion of said stitch width tongue that protrudes rearwardly of said pressing plate;

a pivotally mounted switching lever having an upper end fitted in said fitting hole and an operational end that protrudes from said over-lock stitch unit.

8. The machine of claim 1, wherein:

a supporting shaft is positioned on said sewing machine portion forward of said side connecting surface;

a vertical bearing portion is positioned at a forward position along one of said over-lock stitch unit connecting surface and said covering hem unit connecting surface; and said vertical bearing portion is mounted on said supporting shaft such that one of said over-lock stitch unit and said covering hem unit can be pivoted to a non-use position.

9. A sewing machine, comprising:

a serger that includes:

a needle mounted to be capable of rising and falling from a needle position, a machine base having a side connecting surface spaced from the needle position, a lower shaft having a lower shaft coupling at said connecting surface, a serger fitting portion at said connecting surface, and a serger connector for connecting said machine base to a sewing unit;

a sewing unit comprising:

one unit body having a needle plate, feeding teeth, a looper mechanism, a looper driving mechanism, a cloth feeding mechanism connected with said feeding teeth, a rotary shaft coupling connected with said mechanisms and for connection with said lower shaft coupling, a sewing unit fitting portion adapted to engage with said sewing machine portion fitting portion, a sewing unit connector adapted to be connected with said serger connector for connecting said machine base to said serger unit, and a sewing unit connecting surface for engagement with said connecting surface of said machine base of said serger, said sewing unit connecting surface having said rotary shaft coupling, said sewing unit fitting portion, and said sewing unit connector provided thereat, whereby said sewing unit can be detachably mounted to said serger;

wherein said serger is an over-lock stitching machine and said sewing unit further comprises a knife mechanism and a knife driving mechanism;

wherein said sewing unit further comprises:

a knife fixing feed bar mounted for lateral movement and having a knife mounted thereon;

a pivotal shaft mounted in said sewing unit extending from said knife fixing feed bar toward said sewing unit connecting surface; and a knife cover having a lower edge that is pivotally mounted onto said pivotal shaft, said knife cover defining a cut waste removal chute, whereby said knife cover is linked for lateral movement together with said knife fixing feed bar.

10. The machine of claim 9, wherein:

a front cover is pivotally mounted at a lower edge thereof onto said machine base, said front cover having a guide groove formed in one side thereof; and said knife cover is disposed adjacent to said front cover at one side thereof, said knife cover having a fitting pin disposed in said guide groove, whereby said knife cover opens and closes, pivoting about said pivotal shaft, together with opening and closing movement of said front cover.

11. The machine of claim 9, wherein:

a supporting shaft is positioned on said serger forward of said side connecting surface;

a vertical bearing portion is positioned at a forward position along said sewing unit connecting surface; and said vertical bearing portion is mounted on said supporting shaft such that said sewing unit can be pivoted to a non-use position.

12. A sewing machine, comprising:

a serger that includes:

a needle mounted to be capable of rising and falling from a needle position, a machine base having a side connecting surface spaced from the needle position, a lower shaft having a lower shaft coupling at said connecting surface, a serger fitting portion at said connecting surface, and a serger connector for connecting said machine base to a sewing unit; and a sewing unit comprising:

one unit body having a needle plate, feeding teeth, a covering hem looper mechanism, a covering hem looper driving mechanism, a cloth feeding mechanism connected with said feeding teeth, a rotary shaft coupling connected with said mechanisms and for connection with said lower shaft coupling, a sewing unit fitting portion adapted to engage with said sewing machine portion fitting portion, a sewing unit connector adapted to be connected with said serger connector for connecting said machine base to said serger unit, and a sewing unit connecting surface for engagement with said connecting surface of said machine base of said serger, said sewing unit connecting surface having said rotary shaft coupling, said sewing unit fitting portion, and said sewing unit connector provided thereat, whereby said sewing unit can be detachably mounted to said serger.

13. A sewing machine, comprising:

a sewing machine portion that includes:

a needle mounted to be capable of rising and falling from a needle position, a machine base having a side connecting surface spaced from the needle position, a lower shaft having a lower shaft coupling at said connecting surface, a sewing machine portion fitting portion at said connecting surface, and a sewing machine portion connector for connecting said sewing machine base to a sewing unit;

a sewing unit comprising:

one unit body having a needle plate, feeding teeth, a cloth feeding mechanism connected with said feeding teeth, a rotary shaft connected with said cloth feeding mechanism and having a rotary shaft coupling for connection with said lower shaft coupling, a sewing unit fitting portion adapted to engage with said sewing machine portion fitting portion, a sewing unit connector adapted to be connected with said sewing machine portion connector for connecting said sewing machine base to said sewing unit, and a sewing unit connecting surface for engagement with said connecting surface of said machine base of said sewing machine portion, said sewing unit connecting surface having said rotary shaft coupling, said sewing unit fitting portion, and said sewing unit connector provided thereat, whereby said sewing unit can be detachably mounted to said sewing machine portion;

wherein said sewing unit connector comprises a projecting member having an aperture; and wherein said sewing machine portion connector comprises a lever having a hook portion for engagement with said aperture at one end, being disposed so as to be able to horizontally pivot in said sewing machine portion, and having another end disposed outside of said sewing machine portion, and a traction spring biasing said lever toward a position in which said hook portion tends to be engaged with said aperture such that when said hook portion is engaged with said aperture, said traction spring pulls said sewing unit connecting surface toward said sewing machine portion connecting surface.

14. The sewing machine of claim 13, and further comprising:

a slit in the circumference of said lower shaft coupling parallel with a line of said lower shaft and defining a rotation stopping position of said lower shaft corresponding to an elevated position of said needle;

a position fixing lever having one end that can be fitted into said slit and another end in contact with said lever; and a spring biasing said position fixing lever against said lever such that said position fixing lever follows said lever in a direction of movement of said lever that releases said hook portion from said aperture, whereby said one end of said position fitting lever engages with said slit and sets a stop position of said lower shaft.

15. A sewing machine, comprising:

a sewing machine portion that includes:

a needle mounted to be capable of rising and falling from a needle position, a machine base having a side connecting surface spaced from the needle position, a lower shaft having a lower shaft coupling at said connecting surface, a sewing machine portion fitting portion at said connecting surface, and a sewing machine portion connector for connecting said sewing machine base to a sewing unit; and a sewing unit comprising:

one unit body having a needle plate, feeding teeth, a cloth feeding mechanism connected with said feeding teeth, a rotary shaft connected with said cloth feeding mechanism and having a rotary shaft coupling for connection with said lower shaft coupling, a sewing unit fitting portion adapted to engage with said sewing machine portion fitting portion, a sewing unit connector adapted to be connected with said sewing machine portion connector for connecting said sewing machine base to said sewing unit, and a sewing unit connecting surface for engagement with said connecting surface of said machine base of said sewing machine portion, said sewing unit connecting surface having said rotary shaft coupling, said sewing unit fitting portion, and said sewing unit connector provided thereat, whereby said sewing unit can be detachably mounted to said sewing machine portion;

wherein said sewing unit fitting portion comprises a round-headed projection that protrudes from said sewing unit connecting surface and said sewing machine portion fitting portion comprises a cylindrical hole in said sewing machine portion of the same diameter as said projection; and wherein a coil spring is provided in said cylindrical hole, whereby when said sewing unit is released from said sewing machine portion, said coil spring pushes against said projection and thereby separates said sewing unit connecting surface from said sewing machine portion.

16. A sewing machine, comprising:

a sewing machine portion that includes:

a needle mounted to be capable of rising and falling from a needle position, a machine base having a side connecting surface spaced from the needle position, a lower shaft having a lower shaft coupling at said connecting surface, a sewing machine portion fitting portion at said connecting surface, and a sewing machine portion connector for connecting said sewing machine base to a sewing unit; and a plurality of sewing units including an over-lock stitch unit, a covering hem unit and a lock stitch unit, each of said sewing units comprising:

one unit body having a needle plate, feeding teeth, a cloth feeding mechanism connected with said feeding teeth, a rotary shaft connected with said cloth feeding mechanism and having a rotary shaft coupling for connection with said lower shaft coupling, a sewing unit fitting portion adapted to engage with said sewing machine portion fitting portion, a sewing unit connector adapted to be connected with said sewing machine portion connector for connecting said sewing machine base to said sewing unit, and a sewing unit connecting surface for engagement with said connecting surface of said machine base of said sewing machine portion, said sewing unit connecting surface having said rotary shaft coupling, said sewing unit fitting portion, and said sewing unit connector provided thereat, whereby said sewing unit can be detachably mounted to said sewing machine portion;

wherein said sewing unit fitting portion of each of said plurality of sewing units comprises a round-headed projection that protrudes from said sewing unit connecting surface and said sewing machine portion fitting portion comprises a cylindrical hole in said sewing machine portion of the same diameter as said projection; and wherein said sewing unit fitting portion of at least one of said over-lock stitching unit and said covering hem unit is disposed at a location with respect to said sewing unit connecting surface thereof that is different than the location of said sewing unit fitting portion of said lock stitch unit with respect to said sewing unit connecting surface thereof, whereby said sewing unit fitting portion of at least one of said over-lock stitching unit and said covering hem unit is connected with said sewing machine portion fitting portion at a different location than said sewing unit fitting portion of said lock stitch unit;

wherein said sewing machine portion fitting portion comprises a movably mounted contact element engageable by one of said over-lock stitch unit fitting portion and said covering hem unit fitting portion when said over-lock stitch unit and said covering hem unit are connected with said sewing machine portion;

wherein said needle has a needle bar support;

wherein a control rod extends adjacent to said needle bar support, said control being movably mounted from a position out of engagement with said needle bar support to a position in engagement with said needle bar support; and wherein a plurality of links connect said contact element with said control rod, and said contact element is biased by a spring such that when one of said over-lock stitch unit fitting portion and said covering hem unit fitting portion engage with said sewing machine portion fitting portion, said contact element moves against the force of said spring and moves said control rod to said position in engagement with said needle bar support.

17. A sewing machine comprising:

a sewing machine portion that includes:

a needle mounted to be capable of rising and falling from a needle position, wherein said needle has a needle bar support, a zigzag stitching mechanism connected with said needle, including a zigzag lever driven by a zigzag actuator, said zigzag lever transmitting movement to said needle through a zigzag guide plate, and a sewing machine portion fitting portion at said connecting surface; and a plurality of sewing units including at least one of an over-lock stitch unit and a covering hem unit, and a lock stitch unit, each of said sewing units comprising a sewing unit fitting portion adapted to engage with said sewing machine portion fitting portion;

wherein said sewing unit fitting portion of said at least one of an over-lock stitching unit and a covering hem unit is disposed at a location that is different than the corresponding location of said sewing unit fitting portion of said lock stitch unit, whereby said sewing unit fitting portion of said at least one of an over-lock stitching unit and a covering hem unit is connected with said sewing machine portion fitting portion at a different location than said sewing unit fitting portion of said lock stitch unit;

wherein said sewing machine portion fitting portion comprises a movably mounted contact element engageable by said sewing unit fitting portion of said at least one of an over-lock stitching unit and a covering hem unit when connected with said sewing machine portion;

wherein a control rod extends adjacent to said needle bar support, said control rod being movably mounted from a position out of engagement with said needle bar support to a position in engagement with said needle bar support;

wherein a plurality of links connect said contact element with said control rod, and said contact element is biased by a spring such that when said sewing unit fitting portion of said at least one of an over-lock stitching unit and a covering hem unit engages with said sewing machine portion fitting portion, said contact element moves against the force of said spring and moves said control rod to said position in engagement with said needle bar support; and wherein a zigzag actuation clutch comprises a shifter that is interposed between said zigzag plate and said zigzag lever and engaged with one of said plurality of links such that swinging of said zigzag lever is not transmitted to said zigzag guide plate when said at least one of an over-lock stitching unit and a covering hem unit engages with said sewing machine portion.

* * * * *